US011396078B2

(12) United States Patent
Numata

(10) Patent No.: US 11,396,078 B2
(45) Date of Patent: Jul. 26, 2022

(54) GRINDER

(71) Applicant: MAKITA CORPORATION, Anjo (JP)

(72) Inventor: Fumitoshi Numata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 318 days.

(21) Appl. No.: 15/930,048

(22) Filed: May 12, 2020

(65) Prior Publication Data

US 2020/0384597 A1 Dec. 10, 2020

(30) Foreign Application Priority Data

Jun. 10, 2019 (JP) ..... JP2019-108151
Jan. 10, 2020 (JP) ..... JP2020-003071

(51) Int. Cl.
*B24B 23/02* (2006.01)
*B25F 5/02* (2006.01)

(52) U.S. Cl.
CPC ..... *B24B 23/028* (2013.01); *B25F 5/02* (2013.01)

(58) Field of Classification Search
CPC ..... B24B 23/028; B24B 23/005; B24B 23/02; B25F 5/02; B25F 5/006
USPC ..... 451/344, 359
See application file for complete search history.

(56) References Cited

U.S. PATENT DOCUMENTS 3,481,655 A * 12/1969 Campbell ..... F16C 35/077 384/536
3,693,035 A * 9/1972 Ostwald ..... H02K 1/185 310/216.128
4,140,446 A * 2/1979 Fernstrom ..... B25D 17/24 418/270
4,422,239 A * 12/1983 Maier ..... B23Q 11/0046 30/124
6,120,362 A * 9/2000 Etter ..... B25F 5/02 451/354
6,394,191 B1 * 5/2002 Nakane ..... B25F 5/00 310/239
9,278,426 B2 * 3/2016 Numata ..... B24B 55/00
11,045,939 B2 * 6/2021 Kotsuji ..... B26D 1/30
2005/0153636 A1 * 7/2005 Numata ..... B25F 5/008 451/358
2007/0044984 A1 * 3/2007 Fischer ..... B25F 5/006 173/217
2007/0060030 A1 * 3/2007 Pollak ..... B27B 5/32 451/359
2007/0295522 A1 * 12/2007 Bohne ..... B25D 17/24 173/162.2

(Continued)

FOREIGN PATENT DOCUMENTS

JP 2013-119129 A 6/2013

*Primary Examiner* — Dariush Seif
(74) *Attorney, Agent, or Firm* — Oliff PLC

(57) ABSTRACT

Vibrations and a reaction force transferred to an operator are effectively reduced to improve usability and operability. A grinder includes an inner housing accommodating a motor, a final output shaft located in front of the motor, a connecting shaft parallel to the final output shaft, a front elastic member located in front of the connecting shaft, and an outer housing enclosing the inner housing and holding, with the connecting shaft and the front elastic member in between, the inner housing in a relatively rotatable manner.

20 Claims, 15 Drawing Sheets

(56) References Cited

U.S. PATENT DOCUMENTS

2008/0202784 A1* 8/2008 Stierle ..... B25F 5/006 173/162.1
2010/0193210 A1* 8/2010 Krauter ..... B25F 5/006 173/171
2011/0021120 A1* 1/2011 Bogardi ..... B24B 23/02 451/344
2011/0203826 A1* 8/2011 Hosokawa ..... B24B 23/02 173/217
2012/0080207 A1* 4/2012 Numata ..... B24B 47/28 173/216
2012/0111595 A1* 5/2012 Schadow ..... B25F 5/006 173/162.2
2012/0118599 A1* 5/2012 Schadow ..... B25F 5/006 173/162.2
2012/0244788 A1* 9/2012 Numata ..... B24B 23/028 451/359
2013/0023189 A1* 1/2013 Numata ..... B23Q 11/0092 451/344
2013/0209017 A1* 8/2013 Schadow ..... F16C 33/30 267/141
2015/0217422 A1* 8/2015 Esenwein ..... B25F 5/00 173/217
2016/0221088 A1* 8/2016 Aoki ..... B24B 45/006
2016/0221175 A1* 8/2016 Aoki ..... B25F 5/006
2016/0229038 A1* 8/2016 Matsumoto ..... B25F 5/006
2017/0050291 A1* 2/2017 Aoki ..... B23D 51/10
2017/0050292 A1* 2/2017 Aoki ..... B27B 5/32
2017/0072532 A1* 3/2017 Kawakami ..... B24B 55/052
2017/0125192 A1* 5/2017 Hanai ..... H01H 9/06
2017/0136599 A1* 5/2017 Aoki ..... B24B 23/04
2017/0239802 A1* 8/2017 Aoki ..... B25F 5/02
2017/0334056 A1* 11/2017 Kawakami ..... B25F 5/006
2018/0117728 A1* 5/2018 Kawakami ..... B25F 5/026
2018/0283508 A1* 10/2018 Aoki ..... B25F 5/02
2019/0168371 A1* 6/2019 Aoki ..... B23D 51/01
2019/0168372 A1* 6/2019 Aoki ..... B24B 23/04
2019/0366502 A1* 12/2019 Aoki ..... B24B 23/022
2020/0262047 A1* 8/2020 Numata ..... B25F 5/02
2020/0353610 A1* 11/2020 Huggenberger ..... B25F 5/02
2020/0384627 A1* 12/2020 Numata ..... B25F 5/026
2021/0094164 A1* 4/2021 Numata ..... B25F 5/026

* cited by examiner

GRINDER

CROSS-REFERENCE TO RELATED APPLICATIONS

This application claims the benefit of priority to Japanese Patent Application No. 2019-108151, filed on Jun. 10, 2019, and Japanese Patent Application No. 2020-003071, filed on Jan. 10, 2020 the entire contents of which are hereby incorporated by reference.

BACKGROUND

1. Technical Field

The present invention relates to a grinder.

2. Description of the Background

A grinder described in, for example, Japanese Unexamined Patent Application Publication No. 2013-119129, includes a spindle as a final output shaft facing downward at the front of a housing extending in the front-rear direction, and a tip tool, such as a grinding disc, attached at a lower end of the spindle, and performs grinding or other operations with the rotating tip tool.

BRIEF SUMMARY

Such a known grinder may have vibrations resulting from an unbalanced operation of a motor that rotates at high speed and an unbalanced operation of the tip tool attached to the spindle. The vibrations may be transferred to a hand of an operator through the housing accommodating the motor or a side handle attached to the housing, possibly annoying the operator or affecting the operability.

When the motor is activated or the tip tool receives a load, a reaction force may act on the housing in the direction opposite to the rotation of the tip tool, possibly lowering the operability.

One or more aspects of the present invention are directed to a grinder that effectively reduces vibrations and a reaction force transferred to an operator and improves usability and operability.

An aspect of the present invention provides a grinder, including:

- an inner housing accommodating a motor;
- a final output shaft located in front of the motor;
- a connecting shaft parallel to the final output shaft;
- a front elastic member located in front of the connecting shaft; and
- an outer housing enclosing the inner housing and holding, with the connecting shaft and the front elastic member in between, the inner housing in a relatively rotatable manner.

The structure according to the above aspect of the present invention effectively reduces vibrations and a reaction force transferred to an operator and improves usability and operability.

DETAILED DESCRIPTION

Embodiments of the present invention will now be described with reference to the drawings.

Figure 1:
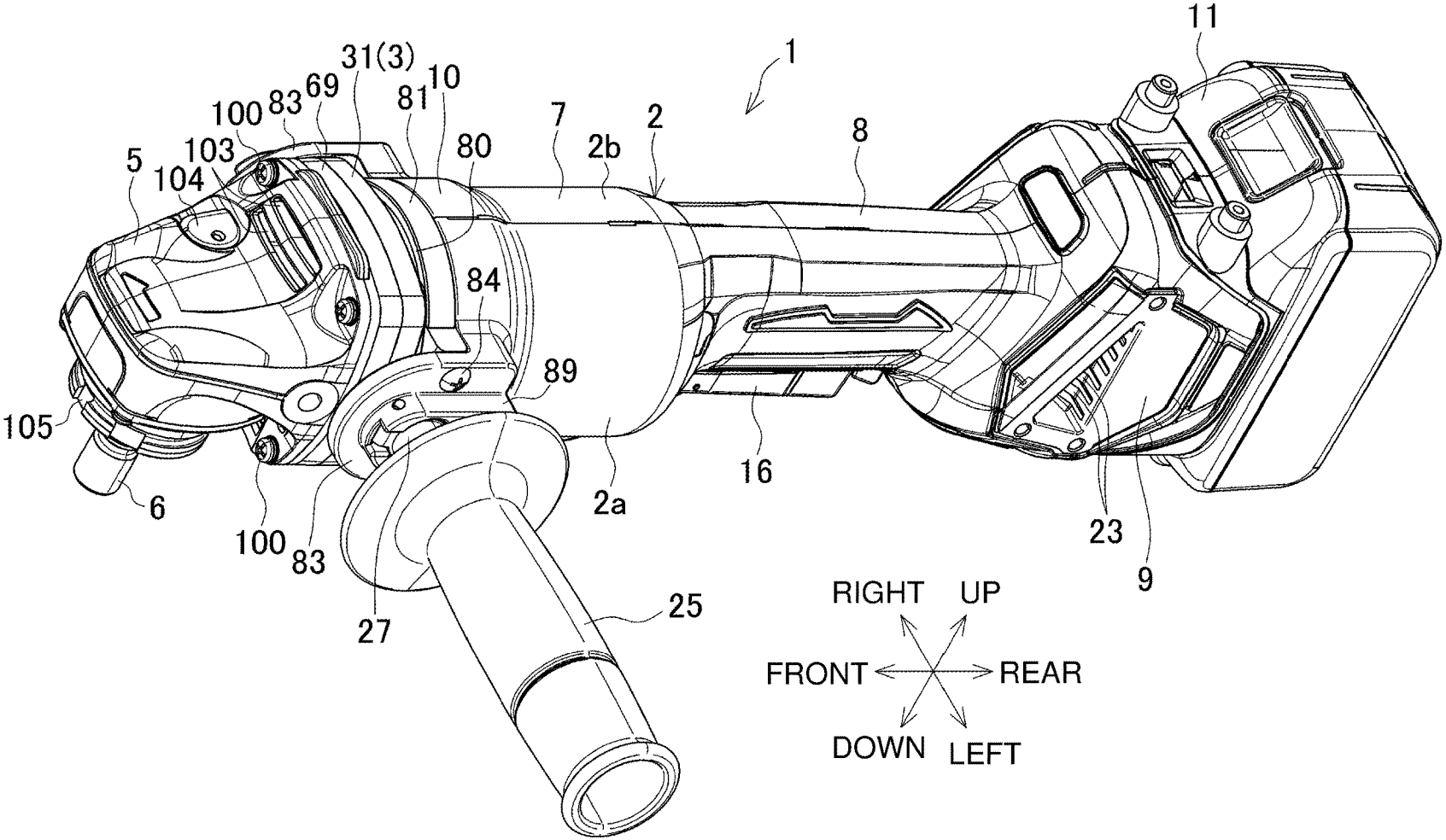
FIG. 1 is a perspective view of a grinder.
Figure 2:
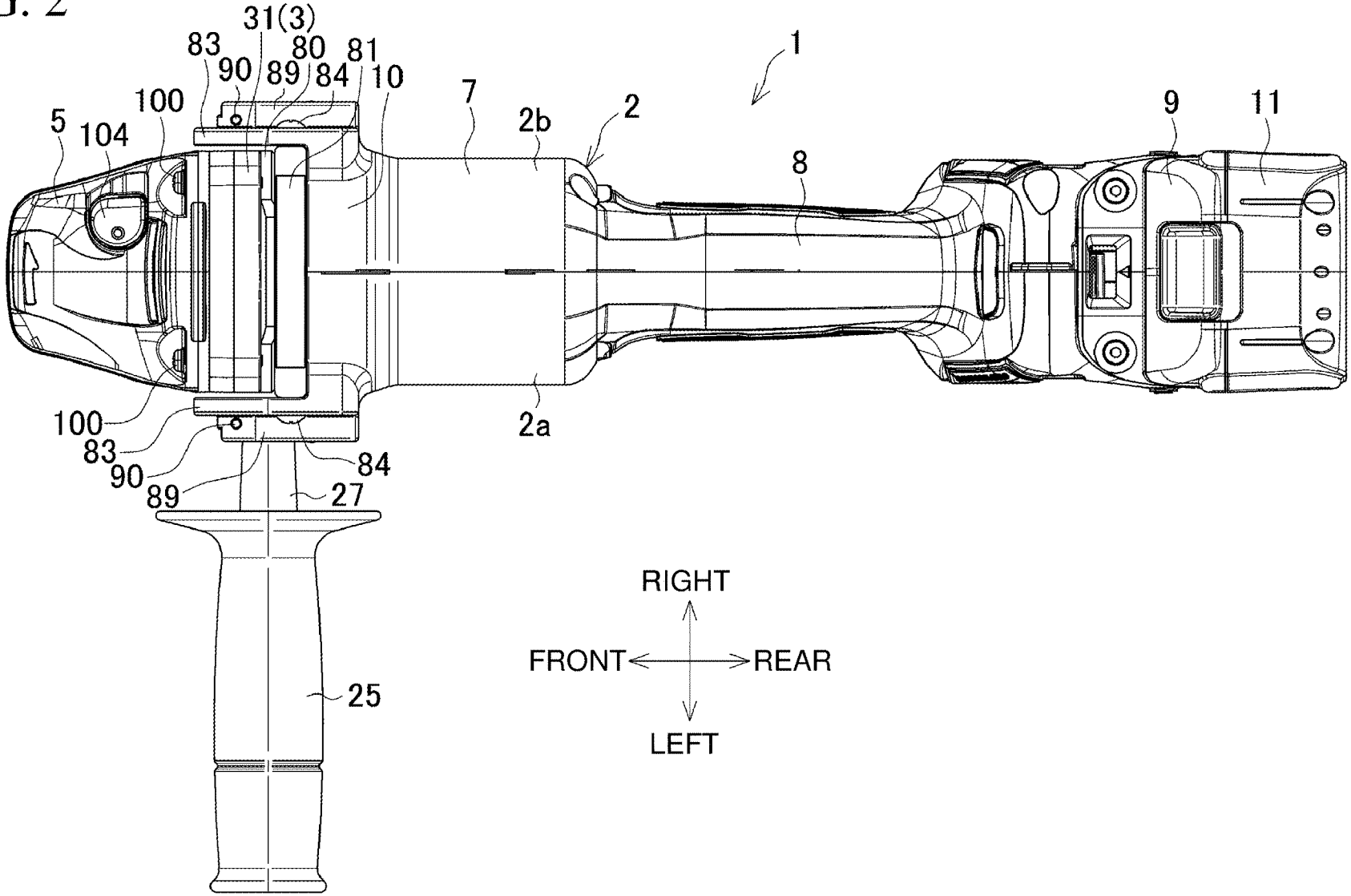
FIG. 2 is a plan view of the grinder.
Figure 3:
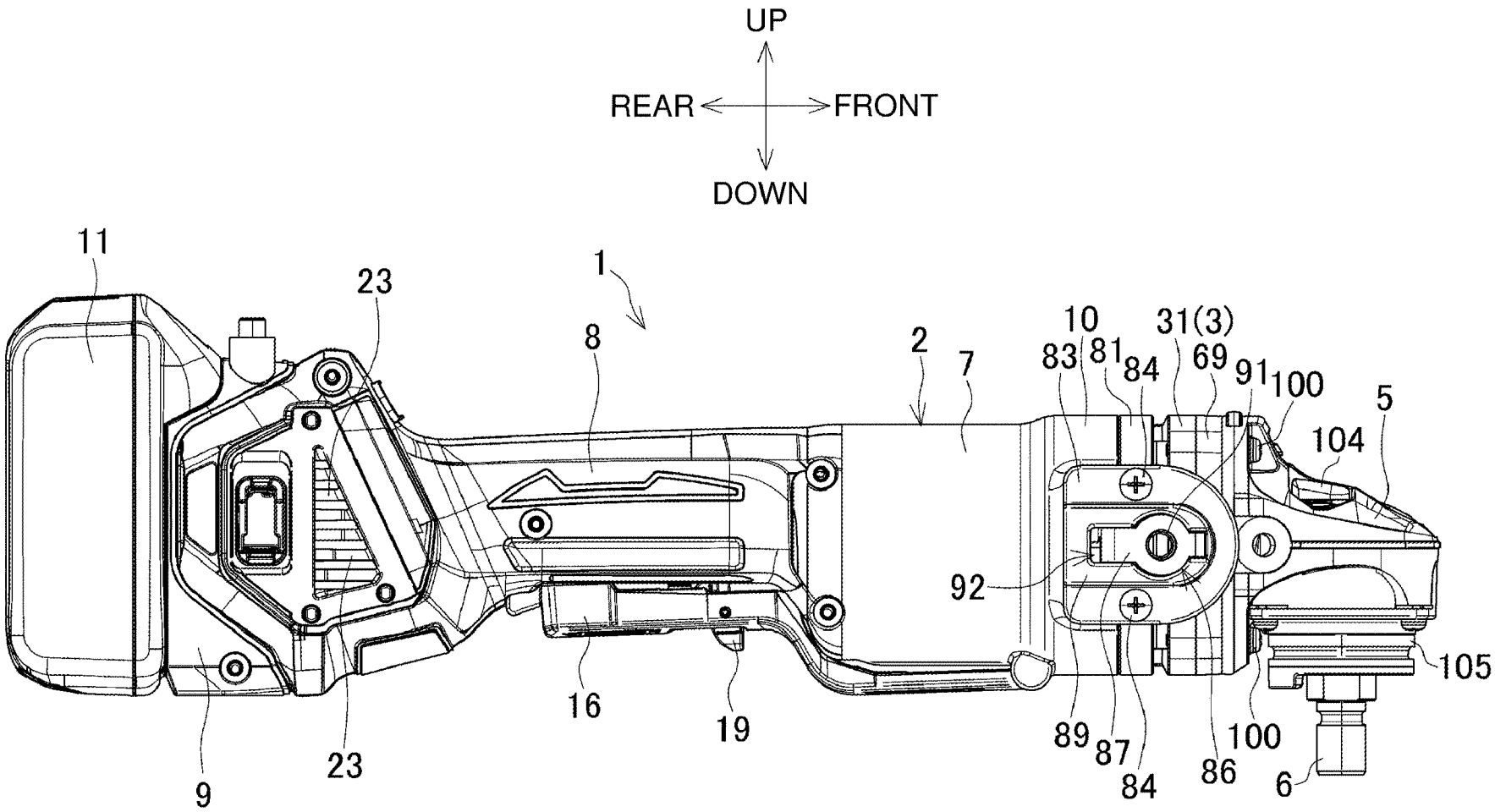
FIG. 3 is a left side view of the grinder.
Figure 4:
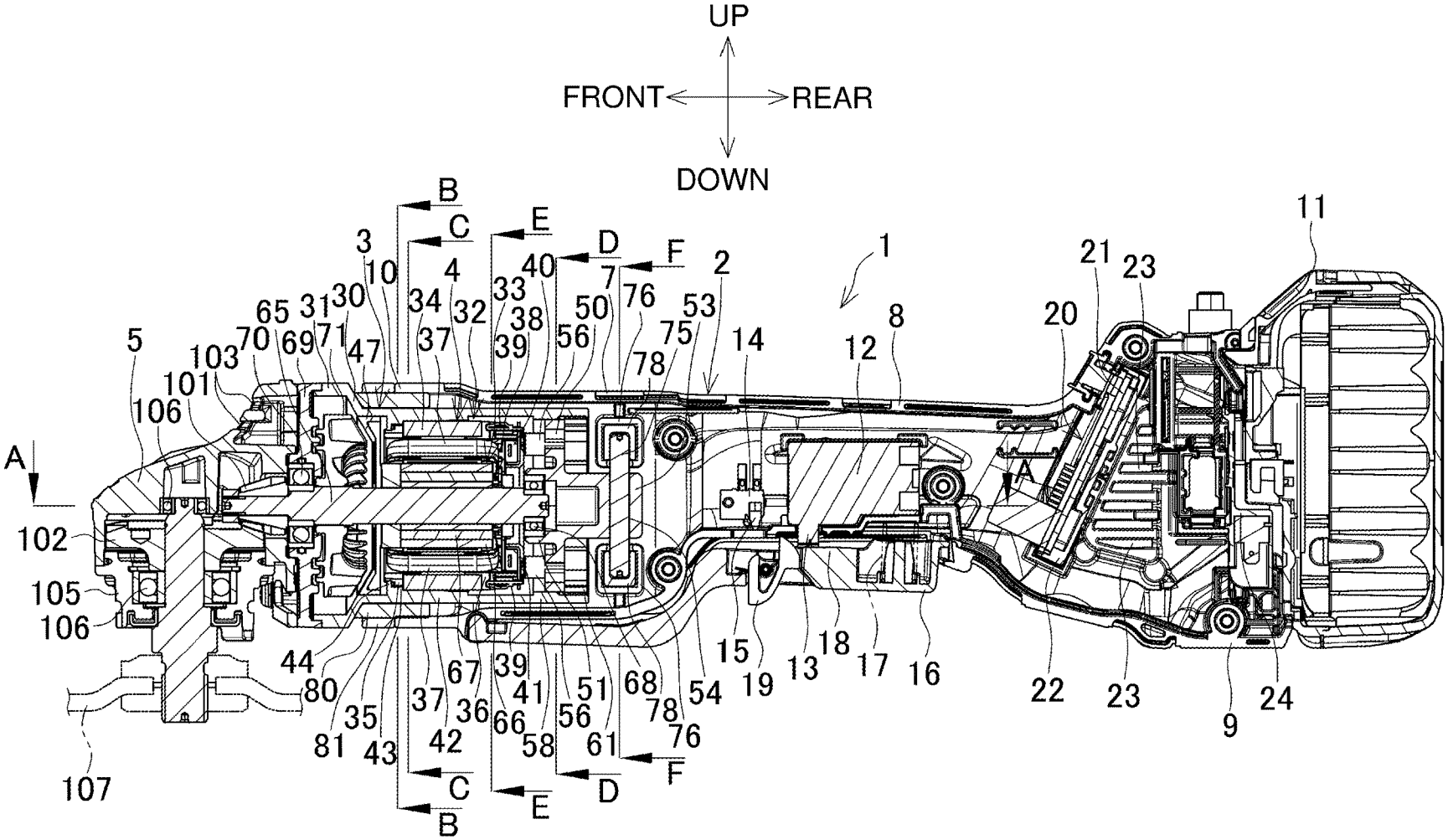
FIG. 4 is a longitudinal central sectional view of the grinder.

FIG. 1 is a perspective view of a rechargeable grinder as an example of a power tool. FIG. 2 is a plan view of the grinder. FIG. 3 is a left side view of the grinder. FIG. 4 is a longitudinal central sectional view of the grinder.

A grinder 1 includes a housing including an outer housing 2, an inner housing 3, and a gear housing 5. The outer housing 2 is cylindrical and extends in the front-rear direction. The inner housing 3 is cylindrical and is located inside the outer housing 2. The inner housing 3 holds a brushless motor 4 and protrudes frontward. The gear housing 5 is connected to the front of the inner housing 3 and accommodates the spindle 6 protruding downward.

The outer housing 2 is formed from a resin and integrally includes a front cylinder 7 with a larger-diameter, a rear cylinder 8 with a smaller-diameter, and a battery mount 9. The front cylinder 7 holds the inner housing 3. The rear cylinder 8 is located behind and decentered upward from the front cylinder 7. The battery mount 9 is located at the rear end of the rear cylinder 8. The outer housing 2 is assembled by fastening a pair of right and left half housings 2*a* and 2*b* with screws.

The front cylinder 7 has, at its front end, a larger-diameter portion 10 with an increased diameter. The battery mount 9 can receive a battery pack 11 as a power supply in a manner slidable from above.

The rear cylinder 8 receives a main switch 12 including a plunger 13, which protrudes downward. The main switch 12 includes a mechanical contact to be turned on to electrically connect a terminal mount 24 (described later) to a control circuit board 21. The mechanical contact is switchable by operating the plunger 13. A microswitch 14 including a button 15 protruding downward is located in front of the main switch 12 in the rear cylinder 8. The microswitch 14 includes an electrical contact to be turned on to electrically connect the control circuit board 21 to the brushless motor 4. The electrical contact is switchable by operating the button 15. A switch lever 16 is vertically swingable on a lower surface of the outer housing 2. The switch lever 16 is pivotable about its front end and extends rearward while bending in conformance with the lower surfaces of the front cylinder 7 and the rear cylinder 8. A coil spring 17 between the rear of the switch lever 16 and the lower surface of the rear cylinder 8 urges the switch lever 16 downward to a protruding position in a normal state.

The switch lever 16 includes a pressing plate 18 and a lock-off lever 19. The pressing plate 18 is pressed upward to press the plunger 13. The lock-off lever 19 is located in front of the pressing plate 18. The lock-off lever 19 in a normal state is urged rotationally into a vertical posture shown in FIG. 4, restricting the switch lever 16 from being pressed. The lock-off lever 19 in FIG. 4 is rotatable counterclockwise to allow the switch lever 16 to be pressed. The rear cylinder 8 is used as a main handle. An operator rotates the lock-off lever 19 counterclockwise with fingers holding the rear cylinder 8 and then grips the switch lever 16. This causes the pressing plate 18 to press the plunger 13 and subsequently the lock-off lever 19 to press the button 15.

A controller 20 behind the main switch 12 is supported in a tilt posture with its lower end more frontward than its upper end with respect to the axis of the rear cylinder 8. The controller 20 includes a dish-shaped case 22, which is formed from aluminum. The case 22 accommodates the control circuit board 21. The control circuit board 21 receives, for example, six field-effect transistors (FETs) (not shown) corresponding to coils 37 in the brushless motor 4, a capacitor, and a microcomputer (not shown). The battery mount 9 has inlets 23 as slits on its right and left side surfaces behind the controller 20. The terminal mount 24 is held vertically behind the inlets 23. The terminal mount 24 is electrically connectable when the battery pack 11 is slide-attached from above.

The electric components other than the brushless motor 4 are accommodated in the outer housing 2 behind the inner housing 3 as described above.

Figure 5:
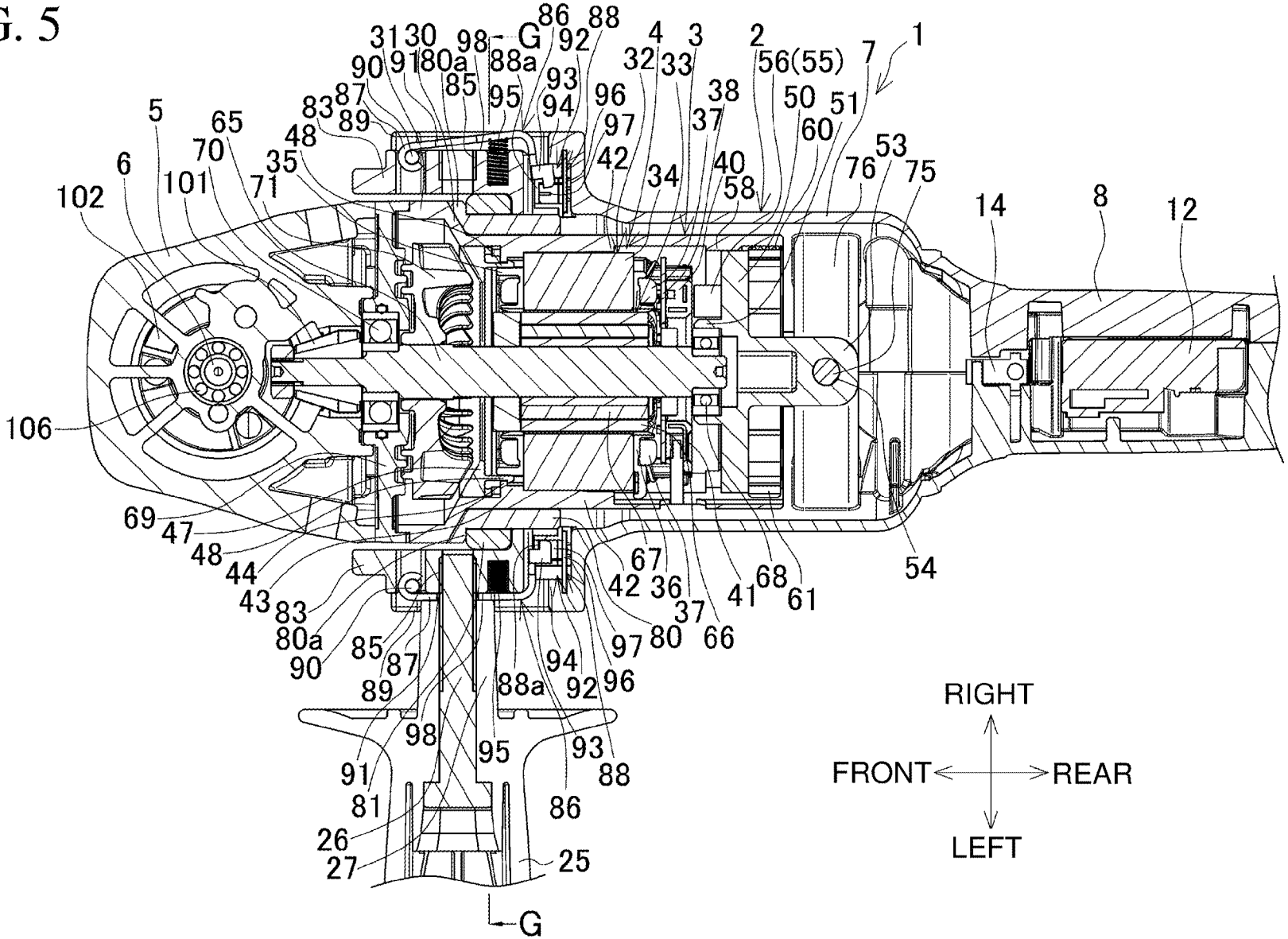
FIG. 5 is an enlarged partial sectional view taken along line A-A in FIG. 4.

The inner housing 3 is formed from a resin and has a smaller diameter than the front cylinder 7 to be enclosed in the front cylinder 7. As shown in FIG. 5, the inner housing 3 has a flared portion 30 and an expanded portion 31 at its front end protruding frontward from the outer housing 2. The flared portion 30 has diameters increasing frontward. The expanded portion 31 extends frontward from the front end of the flared portion 30 and has substantially the same outer diameter as the larger-diameter portion 10.

The brushless motor 4 is an inner-rotor motor including a cylindrical stator 32 and a rotor 33 extending through the stator 32. The stator 32 includes a cylindrical stator core 34, a front insulator 35, a rear insulator 36, and the coils 37. The stator core 34 includes multiple steel plates stacked on one another. The front insulator 35 is located on the axially front end face of the stator core 34. The rear insulator 36 is located on the axially rear end face of the stator core 34. The coils 37 are wound around the stator core 34 with the front and rear insulators 35 and 36 in between. A sensor circuit board 38 and a wire connection member 40 are attached to the rear insulator 36. The sensor circuit board 38 detects the positions of permanent magnets 67 placed in a rotor core. The wire connection member 40 includes a terminal fitting 41 for connecting the coils 37 with fuse terminals 39.

Figure 6B:
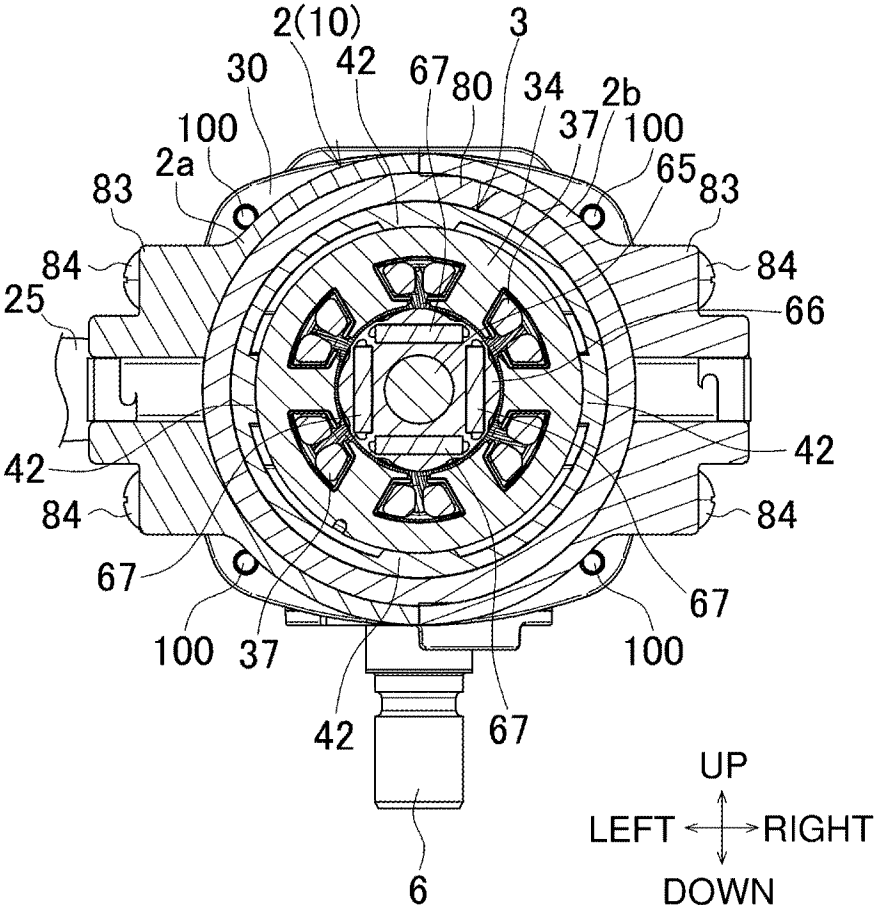
FIG. 6B is an enlarged cross-sectional view taken along line C-C in FIG. 4.
Figure 6A:
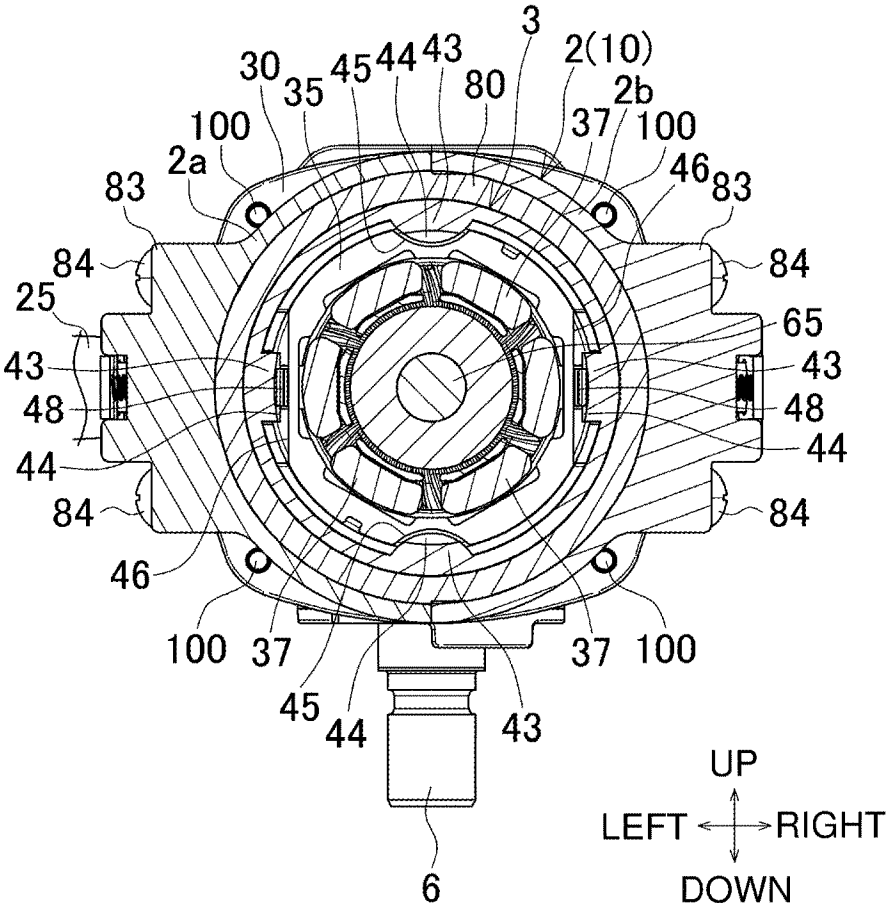
FIG. 6A is an enlarged cross-sectional view taken along line B-B in FIG. 4.
Figure 9:
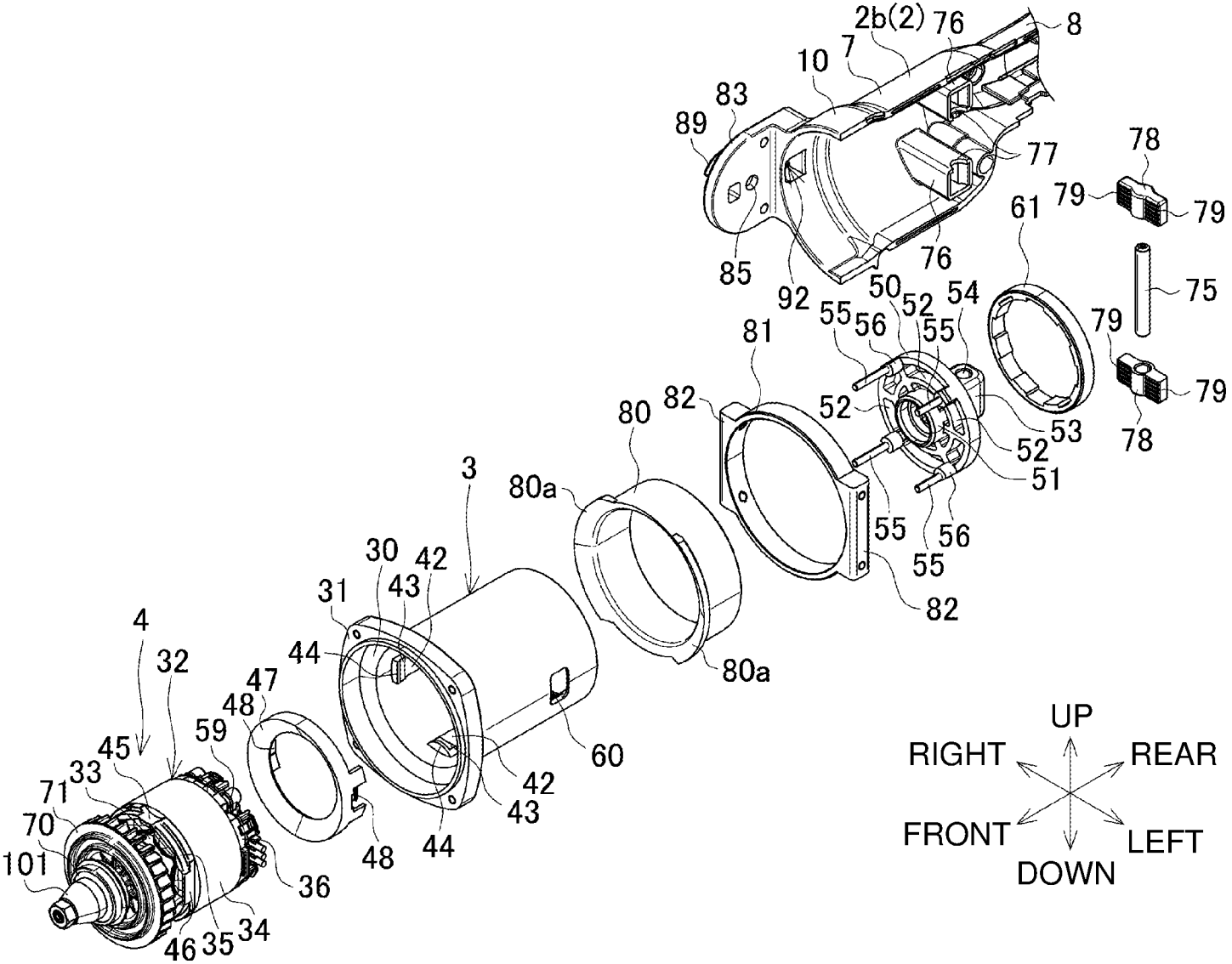
FIG. 9 is an exploded perspective view of an inner housing and a brushless motor, showing their holding structures.

As shown in FIGS. 6A, 6B, and 9, the inner housing 3 has, on its inner front surface, four protrusions 42 elongated in the front-rear direction and protruding toward the axis. The protrusions 42 are arranged at circumferentially equal intervals. Each protrusion 42 has a first projection 43 and a second projection 44 on its front. The first projection 43 and the second projection 44 project more from the inner surface (or become thicker) in a stepwise manner toward the front of the inner housing 3.

The front insulator 35 has a pair of upper and lower fitting recesses 45 and a pair of right and left flat edges 46. The pair of upper and lower fitting recesses 45 are fitted with the second projections 44 when circumferentially aligned with the upper and lower protrusions 42. The pair of right and left flat edges 46 are in no contact with the second projections 44 when circumferentially aligned with the right and left protrusions 42.

The stator 32 is placed into the inner housing 3 from the rear with the fitting recesses 45 circumferentially aligned with the upper and lower protrusions 42 and the flat edges 46 circumferentially aligned with the right and left protrusions 42. The fitting recesses 45 are fitted with the second projections 44 on the upper and lower protrusions 42, thus locking the stator 32 in a nonrotatable manner. The stator core 34 is in contact with the first projections 43 on the protrusions 42. This defines an advanced position of the stator core 34. In this state, the inner surfaces of the protrusions 42 excluding the first and second projections 43 and 44 are in contact with the outer surface of the stator core 34 as shown in FIG. 6B, thus holding the stator core 34.

A ring baffle plate 47 is fitted onto the fronts of the protrusions 42 from the front in the inner housing 3. As shown in FIGS. 5 to 6B, the baffle plate 47 includes right and left hooks 48, which are engaged with, outside the flat edges 46 of the front insulator 35, the second projections 44 on the right and left protrusions 42. This positions the baffle plate 47.

Figure 7B:
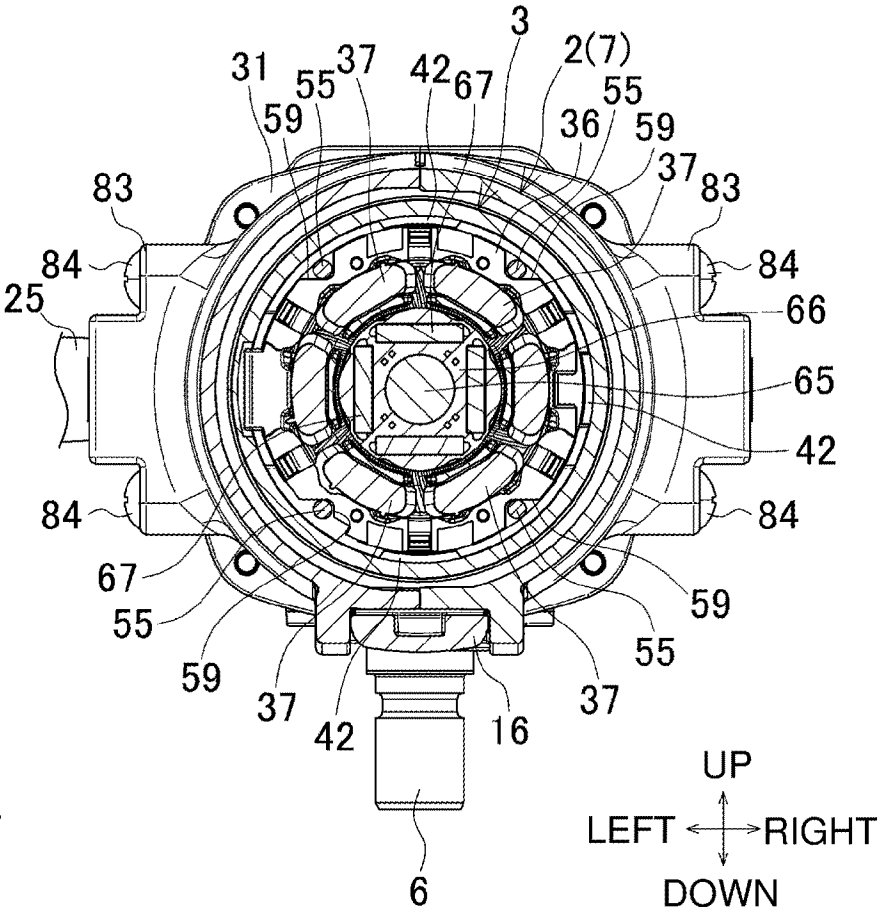
FIG. 7B is an enlarged cross-sectional view taken along line E-E in FIG. 4.
Figure 7A:
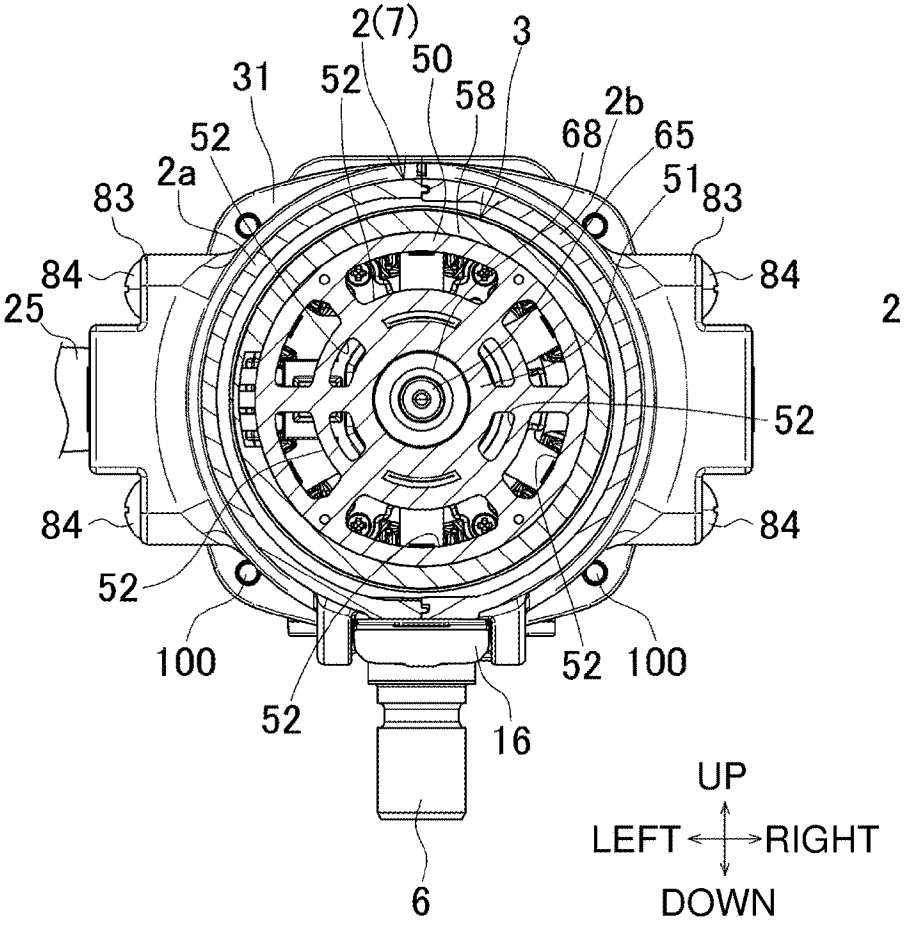
FIG. 7A is an enlarged cross-sectional view taken along line D-D in FIG. 4.

A metal bearing retainer 50 is fitted onto the rear end of the inner housing 3 from the rear. The bearing retainer 50 is disk-shaped and includes a bearing holder 51, multiple arch-shaped through-holes 52, and a joint 53. The bearing holder 51 is at the center of the bearing retainer 50 and has an opening facing frontward. The arch-shaped through-holes 52 surround the bearing holder 51 as shown in FIGS. 7A and 9. The joint 53 is at the rear of the bearing holder 51. The joint 53 protrudes rearward and has a through-hole 54 extending vertically.

The bearing retainer 50 includes four pins 55 protruding from its front surface. The pins 55 are arranged concentrically at equal intervals. Each pin 55 has a larger diameter at a basal portion 56.

The inner housing 3 has a thick portion 58 raised from its inner rear surface. The thick portion 58 has an inner diameter fittable with the bearing retainer 50. Four V-shaped notches 59 are formed on the outer circumference of the rear insulator 36 at circumferentially equal intervals as shown in FIG. 7B.

The pins 55 are circumferentially aligned with the corresponding notches 59 in the rear insulator 36 to place the bearing retainer 50 into the thick portion 58 of the inner housing 3 from the rear. The pins 55 are then engaged with the notches 59 and in contact with the rear surface of the stator core 34 as shown in FIG. 7B. The basal portions 56 are thus located adjacent to the rear surface of the rear insulator 36.

The bearing retainer 50 has an internal thread 60 on its inner circumference at the rear. With the bearing retainer 50 being placed in the thick portion 58, a resin lock ring 61 is screwed onto the internal thread 60. The lock ring 61 thus presses the bearing retainer 50 from the rear, preventing the bearing retainer 50 from slipping off. In this state, the joint 53 protrudes rearward from the inner housing 3 through the center of the lock ring 61.

The rotor 33 includes a rotational shaft 65, a rotor core 66, and the four permanent magnets 67. The rotational shaft 65 is aligned with the axis of the rotor 33. The rotor core 66 surrounds the rotational shaft 65. The rotor core 66 is substantially cylindrical and includes multiple steel plates stacked on one another. The permanent magnets 67 are plates fixed inside the rotor core 66.

The rotational shaft 65 has its rear end axially supported by the bearing 68. The bearing 68 is held in the bearing holder 51 of the bearing retainer 50. The rotational shaft 65 has its front end axially supported by the bearing 70. The bearing 70 is held on a partition 69 attached between the gear housing 5 and the expanded portion 31 of the inner housing 3. The distal end of the rotational shaft 65 protrudes into the gear housing 5. The rotational shaft 65 receives a centrifugal fan 71 behind the partition 69. The centrifugal fan 71 is in front of the baffle plate 47 and is accommodated in the flared portion 30 and the expanded portion 31.

The inner housing 3 holding the brushless motor 4 is elastically held on the outer housing 2. An elastic holding structure will now be described in detail.

Figure 8B:
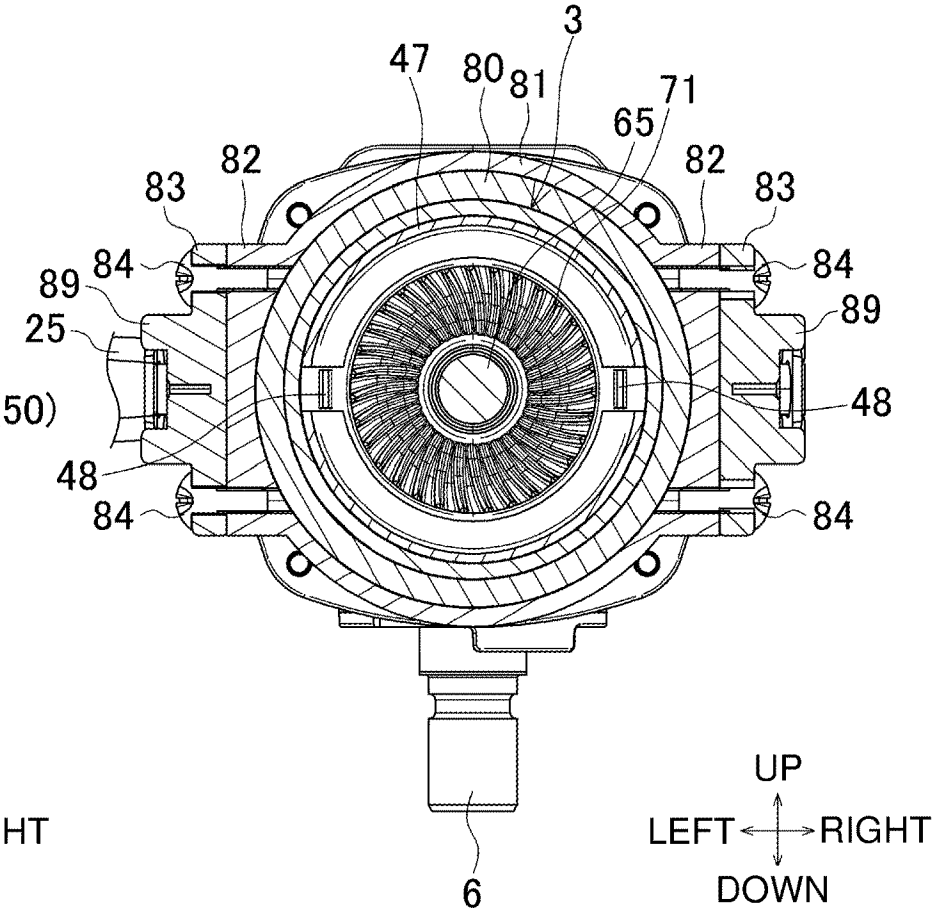
FIG. 8B is an enlarged cross-sectional view taken along line G-G in FIG. 5.
Figure 8A:
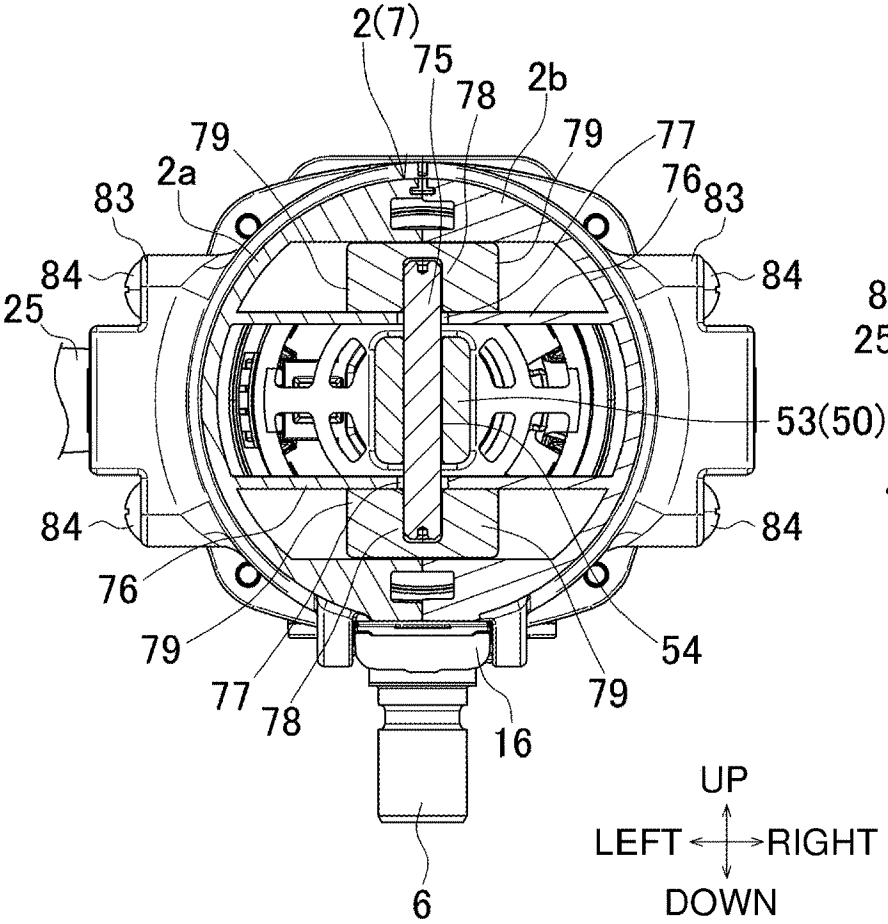
FIG. 8A is an enlarged cross-sectional view taken along line F-F in FIG. 4.

In the bearing retainer 50, a through-hole 54 in the joint 53, which protrudes rearward from the inner housing 3, receives a metal connecting rod 75 extending vertically. The connecting rod 75 has upper and lower ends supported in a pair of upper and lower rod receivers 76, which are hollow prisms as shown in FIGS. 8A and 9. The pair of upper and lower rod receivers 76 each include two half parts on the half housings 2*a* and 2*b* of the outer housing 2 that are combined together. The rod receivers 76 each have an insertion hole 77 for receiving the connecting rod 75 at the interface between the half parts. The rod receivers 76 each hold a rubber cap 78, which receives an end of the connecting rod 75 extending through the insertion hole 77. The rubber cap 78 has a pair of ends 79 extending laterally. Each end 79 is placed into and supported in the corresponding half parts of the rod receiver 76.

The connecting rod 75 extending through the joint 53 is supported in the rod receivers 76, thus holding the inner housing 3 in a laterally swingable manner about the connecting rod 75. The upper and lower ends of the connecting rod 75, which serves as a pivot, are elastically held in the rod receivers 76 with the rubber caps 78.

A rubber cylinder 80 is externally mounted on the outer circumference of the inner housing 3 to cover from the flared portion 30 to a rear portion. The rubber cylinder 80 is held between the larger-diameter portion 10 of the outer housing 2 and the inner housing 3. The rubber cylinder 80 has flanges 80*a* on the right and left edges. The flanges 80*a* are arch-shaped in conformance with the rear surface of the flared portion 30. The inner housing 3 laterally swingable about the connecting rod 75, which is elastically held in the rubber caps 78, is elastically held on the outer housing 2 along its entire front circumference with the rubber cylinder 80 in between. The rubber cap 78 has a lower hardness than the rubber cylinder 80.

A fixing ring 81 is externally mounted on the rubber cylinder 80 between the flared portion 30 and the larger-diameter portion 10. The fixing ring 81 is formed from a metal and has the same outer diameter as the larger-diameter portion 10. The fixing ring 81 has a pair of flat surfaces 82 extending vertically on its right and left side surfaces.

As shown in, for example, FIGS. 2 and 5, a pair of handle mounts 83 are integrally formed on the right and left side surfaces at the front end of the outer housing 2. The pair of handle mounts 83 protrude laterally outward and extend frontward to cover the outer surfaces of the gear housing 5 without being in contact with the outer surfaces of the inner housing 3 and the partition 69. Each handle mount 83 is used to attach a side handle 25 (e.g., FIGS. 1 and 2). Each handle mount 83 is flat on a plane defined in vertical and lateral directions. As shown in FIG. 8B, the handle mounts 83 in contact with the flat surfaces 82 of the fixing ring 81 at their inner surfaces are fastened to the fixing ring 81 with pairs of upper and lower screws 84, which are screwed from outside, or from the right and the left. The right and left half housings 2*a* and 2*b* of the outer housing 2 are thus fastened to the fixing ring 81 through the handle mounts 83, in addition to being directly fastened to each other with the screws.

As shown in FIGS. 5 and 9, each handle mount 83 has, in a middle portion in the front-rear and vertical directions, a screw hole 85 that is a laterally extending through-hole. The side handle 25 includes a threaded portion 26 at its distal end, which is screwed into the screw hole 85 and is fixed. Each handle mount 83 includes a handle detector 86 that detects the side handle 25 attached in the screw hole 85.

Figure 10:
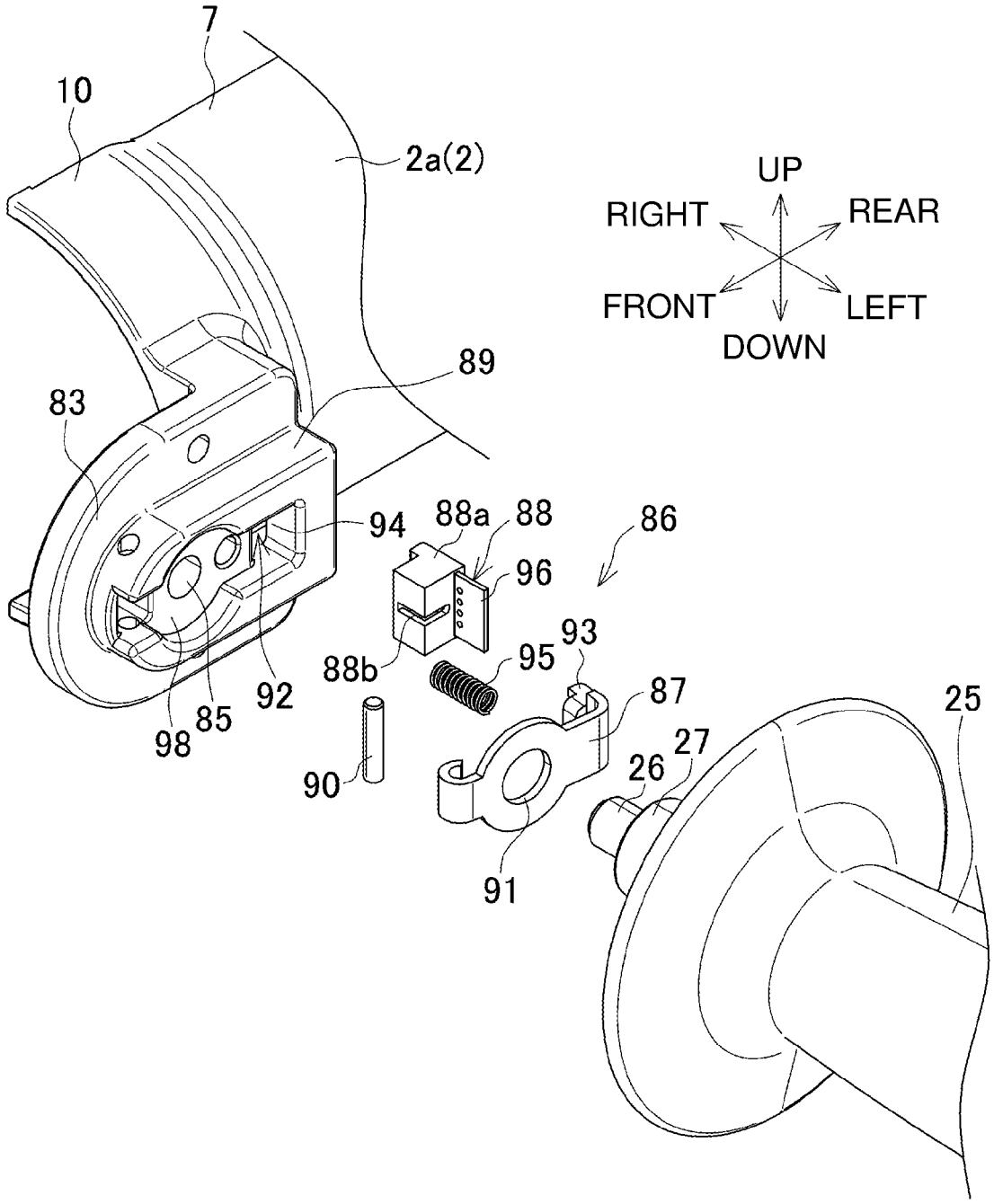
FIG. 10 is an exploded perspective view of a handle detector.

Each handle detector 86 includes a detection plate 87 and a photointerrupter 88 as shown in FIG. 10. The detection plate 87 is at a different position depending on whether the side handle 25 has been attached. The photointerrupter 88 detects the position of the detection plate 87 when the side handle 25 is attached, and outputs a detection signal to the controller 20. In response to the detection signal about the side handle 25, the controller 20 allows the brushless motor 4 to operate.

A pivot pin 90 is vertically supported in a frame 89 protruding on the outer surface of the handle mount 83. The detection plate 87 has a front portion pivotably attached to the pivot pin 90 and a rear portion swingable laterally. The detection plate 87 has, behind the pivot pin 90, a through-hole 91 located outside the screw hole 85. The through-hole 91 can receive the threaded portion 26 of the side handle 25.

The detection plate 87 has a rear end bending inward toward the handle mount 83. The rear end is placed into a holder 92 accommodating the photointerrupter 88 in the handle mount 83. The detection plate 87 includes a light shield 93 at its rear end, or an end to be placed. The handle mount 83 includes a stopper 94 adjacent to the inlet of the holder 92. The stopper 94 comes in contact with the light shield 93 when the detection plate 87 swings outward, restricting the swingable position of the detection plate 87. The handle mount 83 receives, behind the through-hole 91, a coil spring 95 that urges the detection plate 87 toward an outward position at which the detection plate 87 comes in contact with the stopper 94.

The photointerrupter 88 includes a substrate 96. The substrate 96 is held in the lateral direction in a rear portion of the holder 92. The substrate 96 includes a photoreceiver 97 on its front surface. The photoreceiver 97 can detect the light shield 93 placed in the holder 92 in a contactless manner.

When the detection plate 87 is at the outward position, the light shield 93 is outside the photoreceiver 97 without blocking the light entering the photoreceiver 97. The photoreceiver 97 thus enters a non-detection state with no detection signal being output. When the detection plate 87 swings inward against the urging force from the coil spring 95, the side handle 25 comes in contact with a receiver 98 on the outer surface of the handle mount 83. At this inward position, the light shield 93 blocks light entering the photoreceiver 97. The photoreceiver 97 thus enters a detection state with a detection signal being output. The photointerrupter 88 includes a dust cover 88*a* covering the photoreceiver 97 and a part of the substrate 96 excluding a slit 88*b* through which the light shield 93 passes.

The gear housing 5 is fastened to the inner housing 3 with four screws 100 at four corners viewed from the front, which are placed from the front with the partition 69 between the gear housing 5 and the inner housing 3. A bevel gear 101 is fixed on the front end of the rotational shaft 65 protruding into the gear housing 5. As shown in FIG. 4, the bevel gear 101 meshes with a bevel gear 102 fixed on the upper end of the spindle 6. The gear housing 5 has, on its front surface, outlets 103 that communicate with the inner housing 3 through a through-hole (not shown) in the partition 69. A shaft lock 104 is located in front of the outlets 103. The shaft lock 104 can lock the spindle 6 not to rotate via the bevel gear 102 when pressed.

The spindle 6 is axially supported by upper and lower bearings 106, and protrudes downward. The upper bearing 106 is held on the gear housing 5. The lower bearing 106 is held on a bearing box 105 attached to the bottom of the gear housing 5. The spindle 6 has a lower end to receive a tip tool 107 (FIG. 4), such as a grinding disc. The bearing box 105 can receive, on its outer circumference, a wheel cover (not shown) covering a rear half of the tip tool 107.

In the grinder 1 according to the present embodiment, the threaded portion 26 of the side handle 25 is screwed into the screw hole 85 in either the right or left handle mount 83 through the through-hole 91 in the detection plate 87. The side handle 25 has a distal end 27 holding the threaded portion 26. The distal end 27 presses the detection plate 87 inward against the urging force from the coil spring 95, thus pressing the detection plate 87 against the receiver 98. In response to the side handle 25 attached, the detection plate 87 swings to the inward position and causes the light shield 93 to block light entering the photoreceiver 97 in the photointerrupter 88.

The operator rotates the lock-off lever 19 with fingers holding the rear cylinder 8 to unlock the lock-off lever 19, and then grips the switch lever 16. The pressing plate 18 presses the plunger 13 to first turn on the main switch 12. This allows the battery pack 11 to power the control circuit board 21 in the controller 20. The control circuit board 21 determines whether the photointerrupter 88 outputs a detection signal.

When the operator grips the switch lever 16 further, the lock-off lever 19 presses the button 15 in the microswitch 14 to turn on the microswitch 14. In response to a detection signal from the photointerrupter 88 and an on signal from the microswitch 14, the control circuit board 21 controls the battery pack 11 to power the brushless motor 4 and activate the brushless motor 4. More specifically, the microcomputer in the control circuit board 21 receives, from a rotation detection element in the sensor circuit board 38, a rotation detection signal indicating the positions of the permanent magnets 67 in the rotor 33, and determines the rotational state of the rotor 33. The microcomputer in the control circuit board 21 controls the on-off state of each FET in accordance with the determined rotational state, and applies a current through the coils 37 in the stator 32 sequentially to rotate the rotor 33. The rotational shaft 65 thus rotates and causes the spindle 6 to rotate (rotate clockwise as viewed from above) via the bevel gears 101 and 102 to allow grinding or other operations with the tip tool 107.

The rotor 33 in the brushless motor 4 that rotates at high speed and the tip tool 107 attached to the spindle 6 may cause unbalanced operations. This may cause vibrations to be transferred to the inner housing 3 and the gear housing 5.

The rubber cylinder 80 is held between the inner housing 3 and the outer housing 2 in the present embodiment. This structure effectively isolates such vibrations, thus reducing vibrations transferred to the outer housing 2. The operator is thus less likely to receive vibrations on his or her hand holding the rear cylinder 8 as a main handle. The side handle 25 is attached to the handle mount 83 on the outer housing 2, which also isolates vibrations. The operator is thus less likely to receive vibrations on his or her hand holding the side handle 25. This structure achieves lower vibrations.

When the brushless motor 4 is activated or the tip tool 107 receives a load during rotation, the inner housing 3 is urged to rotate counterclockwise (in a direction in which a reaction force is applied) about the connecting rod 75 as viewed in plan. The rubber cylinder 80 is held between the inner housing 3 and the outer housing 2 in the present embodiment. The rubber cylinder 80 thus absorbs the rotation of the inner housing 3 to reduce a reaction transferred to the outer housing 2 and the side handle 25 attached to the outer housing 2.

When the centrifugal fan 71 rotates together with the rotational shaft 65, the outside air is drawn through the inlets 23 behind the centrifugal fan 71, passes under the controller 20, and advances through the outer housing 2. This cools the controller 20 and the terminal mount 24.

The airflow in the outer housing 2 passes through the main switch 12 and the microswitch 14 while cooling them, enters the inner housing 3 through the through-holes 52 in the bearing retainer 50, and passes between the stator 32 and the rotor 33 in the brushless motor 4 to cool the brushless motor 4. The airflow then passes through the flared portion 30 and expanded portion 31 to the gear housing 5 through the partition 69, and is then discharged through the outlets 103.

The grinder 1 according to the present embodiment includes the inner housing 3 accommodating the brushless motor 4 (motor), the spindle 6 (final output shaft) in front of the brushless motor 4, and the outer housing 2 enclosing the inner housing 3 and integral with the rear cylinder 8 (handle). The inner housing 3 and the outer housing 2 are connected in a relatively rotatable manner with the connecting rod 75 (connecting shaft) parallel to the spindle 6. The inner housing 3 is held on the outer housing 2 with the rubber cylinder 80 (front elastic member) in between in front of the connecting rod 75. This structure effectively reduces vibrations and a reaction force transferred to the operator and improves usability and operability.

In particular, the connecting rod 75 is held with the rubber cap 78 (rear elastic member) in the outer housing 2. This effectively reduces vibrations transferred from the connecting rod 75 to the outer housing 2.

The outer housing 2 includes the handle mounts 83 (mounts to which the side handle is attachable). This also effectively prevents vibrations and a reaction force from being transferred to the side handle 25.

The outer housing 2 includes the pair of right and left half housings 2*a* and 2*b* that are assembled together. The half housings 2*a* and 2*b* are fixed to the fixing ring 81 (ring), which is externally mounted on the inner housing 3 with the rubber cylinder 80 in between. The half housings 2*a* and 2*b* are thus firmly joined together with the fixing ring 81 between them.

The joint 53 (a joint portion connected to the connecting shaft) in the inner housing 3 is formed from a metal to provide sufficient strength.

The inner housing 3 accommodates the brushless motor 4 in a cylindrical holder. The rubber cylinder 80 thus effectively isolates vibrations along the entire circumference.

The outer housing 2 accommodates the electric components other than the brushless motor 4, such as the main switch 12, the microswitch 14, the controller 20, and the terminal mount 24. These electric components are located apart from the brushless motor 4 and the tip tool 107, which are vibration sources, and located in a manner isolated from vibrations. This protects the electric components against vibrations.

The outer housing 2 includes the battery packs 11 (batteries) serving as a power supply. The outer housing 2 thus has an increased weight, effectively reducing vibrations.

The rubber cap 78 has a lower hardness than the rubber cylinder 80. This effectively prevents transfer of a reaction force.

The connecting shaft may be integral with the joint in the bearing retainer, instead of being separate from the bearing retainer, similarly to the connecting rod 75 in the present embodiment. The connecting shaft may be directly located on the inner housing without using a separate member such as a bearing retainer. The rear elastic member for elastically holding the connecting shaft may be eliminated.

The handle mounts may not be on the outer housing. A known structure including a side handle attached to a gear housing may also provide certain vibration reduction with the elastically held inner housing.

The outer housing may not be halved as in the present embodiment, but may be an integral cylinder similarly to the inner housing. The grinder may operate on an alternating current (AC) without including batteries or may include a motor other than a brushless motor.

The grinder 1 (power tool) according to the present embodiment includes the inner housing 3 accommodating the brushless motor 4 (motor), the spindle 6 (final output shaft) drivable by the brushless motor 4, and the outer housing 2 enclosing the inner housing 3 and integral with the rear cylinder 8 (handle). The inner housing 3 is held on the outer housing 2 with the rubber cylinder 80 (elastic member) in between. The outer housing 2 includes the handle mounts 83 (mounts to which the side handle is attachable) and the handle detectors 86 each for detecting the side handle 25 attached. More specifically, the handle detectors 86 are located on the outer housing 2, which is isolated using the rubber cylinder 80 from vibrations generated by the brushless motor 4 and the spindle 6 (tip tool 107). The grinder 1 thus includes the handle detectors 86 that are less susceptible to vibrations and are highly durable and reliable.

In particular, the handle detectors 86 each detect the side handle 25 attached, in response to an attaching operation of the side handle 25. The handle detectors 86 do not cause any additional operation for detection.

The handle detectors 86 are provided at multiple (two in the embodiment) locations. The side handle 25 attached is thus independently detectable on each handle mount 83.

The handle detectors 86 are located in right and left portions of the outer housing 2. The side handle 25 is thus detectable on either the right or left handle mount 83.

The inner housing 3 is connected to the outer housing 2 with the connecting rod 75 (connecting shaft) parallel to the spindle 6. This structure effectively reduces a reaction force transferred to the operator generated when the brushless motor 4 is activated or the tip tool 107 receives a load.

The handle detectors 86 operate in a contactless manner. The handle detectors 86 are less likely to have failures or erroneous detection caused by foreign matter such as dust, and are expected to have higher durability and reliability.

Each side handle detector 86 includes the detection plate 87 (detection member) having the front portion swingable about the pivot pin 90 (pivot). The detection plate 87 comes in contact with the side handle 25 when the side handle 25 is attached. The photointerrupter 88 (detector) located behind the detection plate 87 detects the detection plate 87 that swings when in contact with the side handle 25. The receiver 98 is located between the pivot pin 90 and the photointerrupter 88 to receive the side handle 25. The detection plate 87 thus reliably swings in response to an attaching operation of the side handle 25 to allow the photointerrupter 88 to detect the side handle 25 attached.

The photointerrupter 88 is covered with the dust cover 88*a*. This effectively prevents foreign matter such as dust from entering and improves the reliability of detection.

In the present embodiment, the positional relationship between the pivot pin and the photointerrupter is not limited to the relationship described above and may be modified as appropriate in accordance with the power tool used. For example, the pivot pin and the photointerrupter may be reversed in the front-rear direction or may be arranged in the vertical direction.

The sensor is not limited to a photointerrupter. The sensor may be another contactless sensor such as a proximity sensor including a magnet, or may be a contact sensor such as a microswitch or a pressure switch.

In the present embodiment, the handle detector is provided for each handle mount. In some embodiments, a single handle detector may be used for multiple handle mounts.

The present invention is applicable not only to a grinder but also to other power tools with a mount to which a side handle is attachable, such as an angle drill or a sander. When the inner housing and the outer housing are connected with the connecting shaft in a structure including a final output shaft facing other than downward, the connecting shaft may be aligned parallel to the final output shaft.

The tool may operate on an alternating current (AC) without including batteries or may include a motor other than a brushless motor.

Modifications

In the above embodiment, both the upper and lower ends of the connecting rod 75 are elastically held in the rod receivers 76 with the rubber caps 78. In this structure, the connecting rod 75 may be tilted in the vertical direction when the rubber caps 78 are press-fitted into the rod receivers 76, possibly causing the inner housing 3 to be assembled in a tilted manner. In the tilted inner housing 3, the spindle 6 is also tilted with respect to the rear cylinder 8. This structure insufficiently reduces vibrations and a reaction force. A modification for avoiding such erroneous assembly will now be described. The same components as in the above embodiment are given the same reference numerals and will not be described repeatedly, and the components different from those in the above embodiment will be described.

Figure 12:
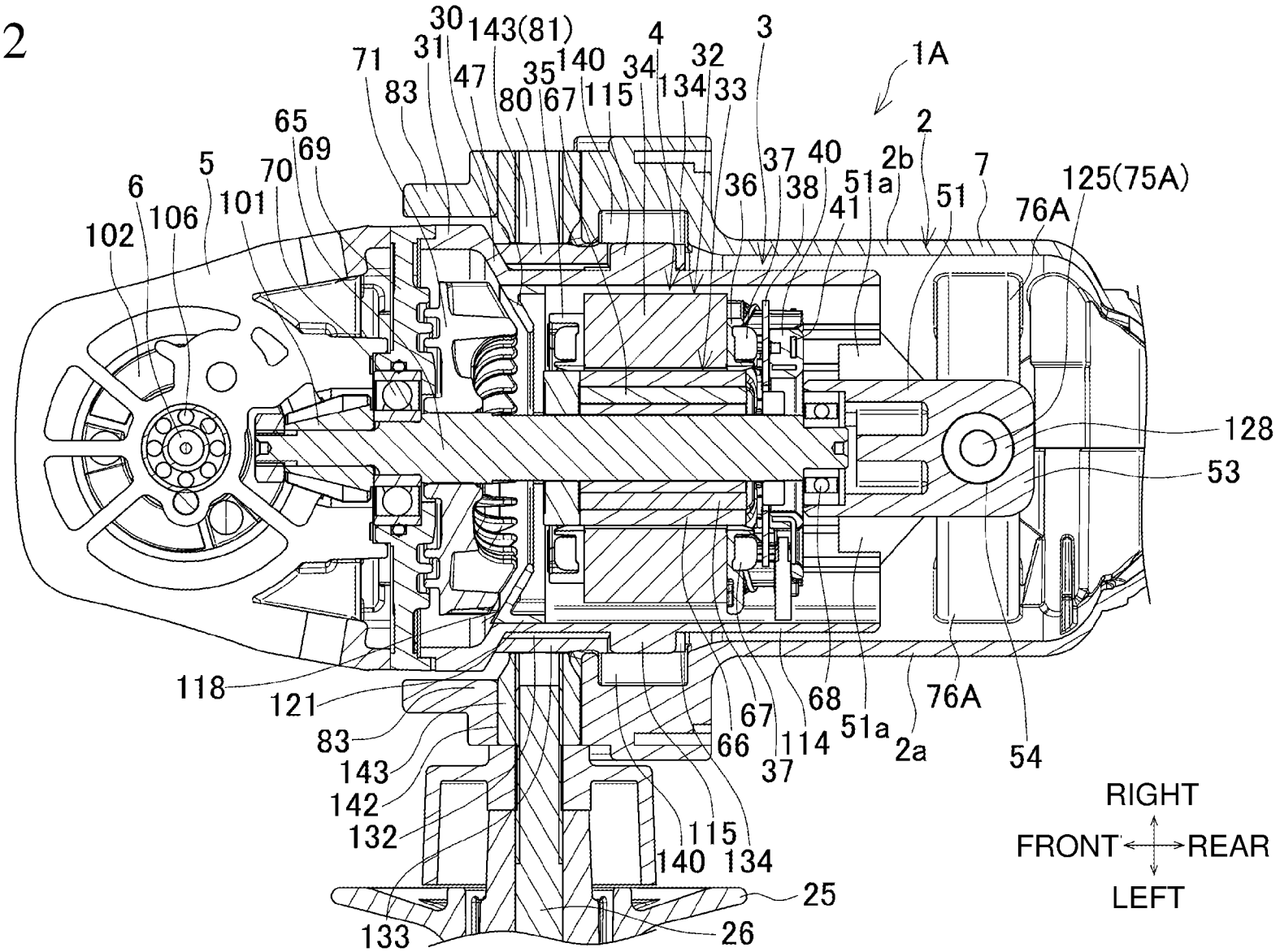
FIG. 12 is a cross-sectional view taken along line H-H in FIG. 11.
Figure 13:
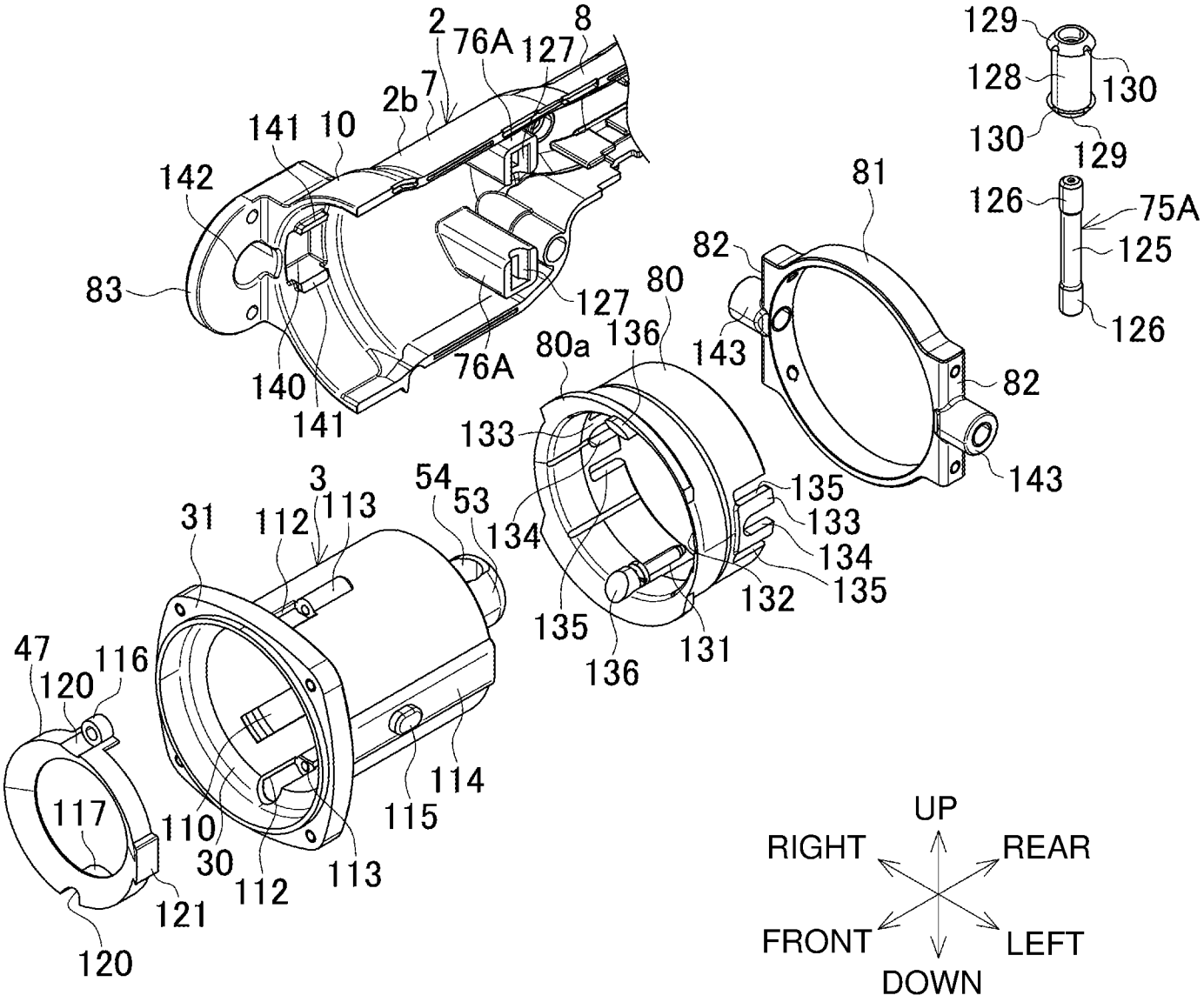
FIG. 13 is an exploded perspective view of the grinder according to the modification, showing the elastic holding structure of the inner housing.
Figure 15B:
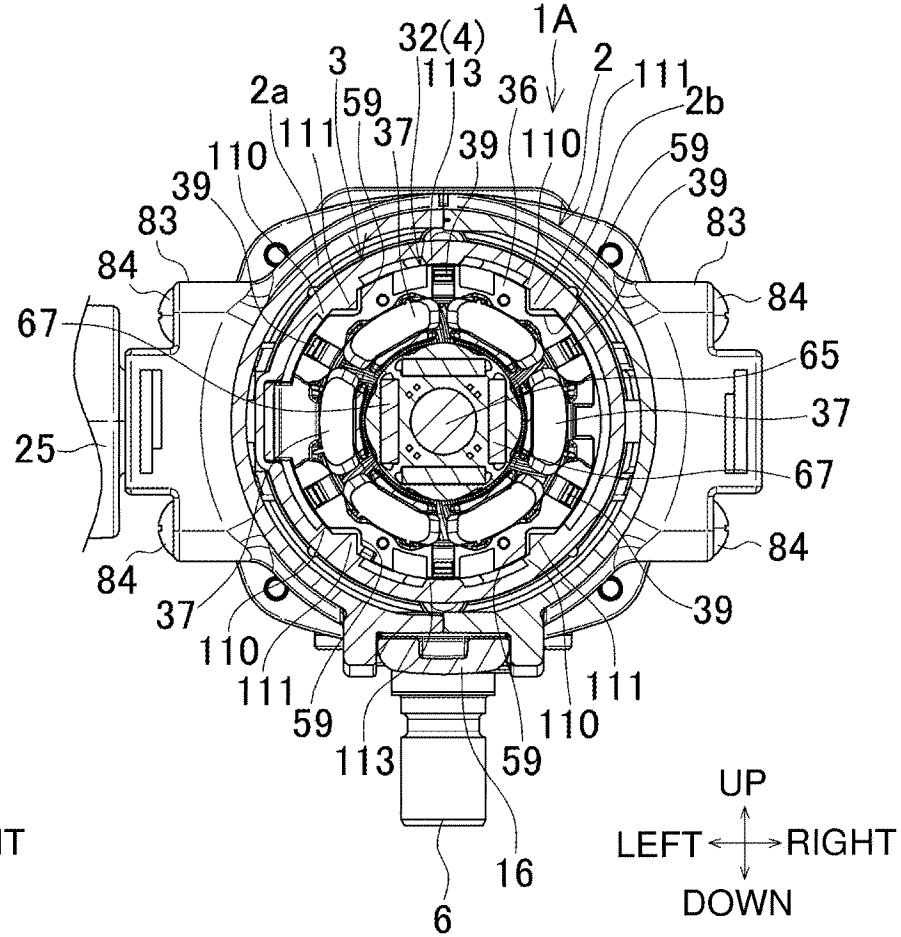
FIG. 15B is a cross-sectional view taken along line K-K in FIG. 11.
Figure 15A:
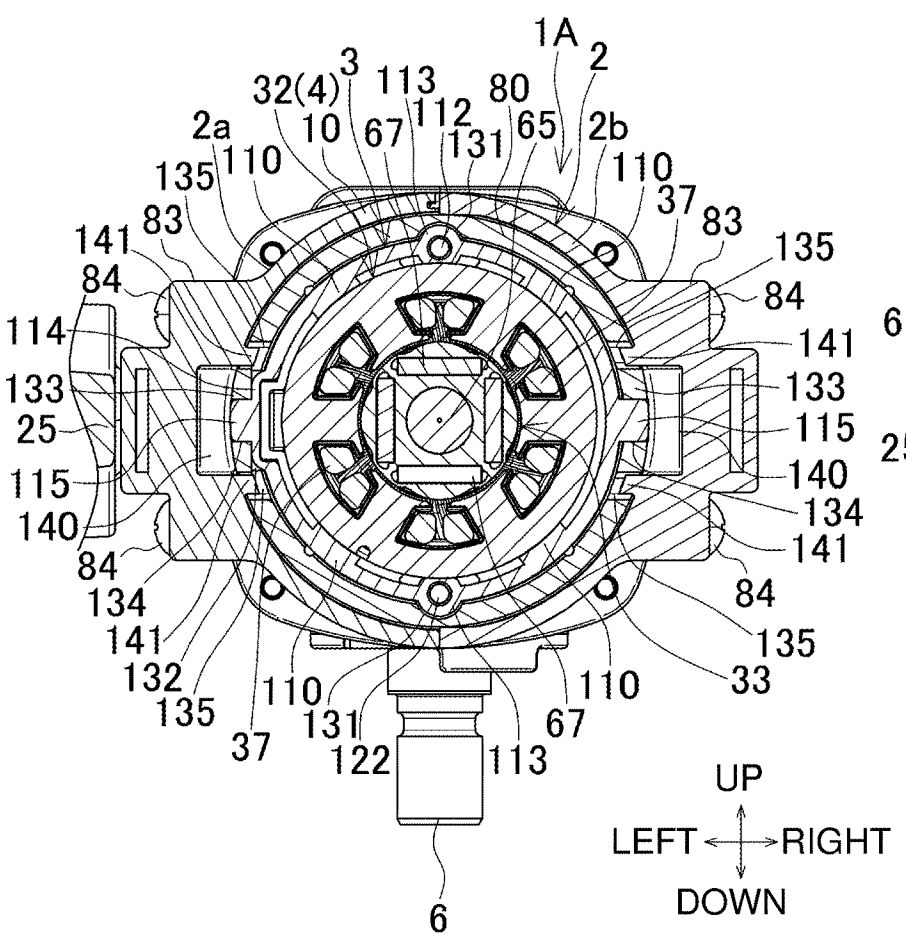
FIG. 15A is a cross-sectional view taken along line J-J in FIG. 11.

The assembly of a stator 32 will be described first. For a grinder 1A shown in FIGS. 11 and 12, the stator 32 is placed into an inner housing 3 from the front. The inner housing 3 has, on its inner surface, four receiving surfaces 110 protruding toward the axis as shown in FIGS. 13 and 15A. The receiving surfaces 110, which extend in the front-rear direction, are arranged at circumferentially equal intervals. Each receiving surface 110 includes an engagement portion 111 at its rear as shown in FIG. 15B. The engagement portion 111 has a triangle cross section and protrudes more toward the axis than its front portion.

The inner housing 3 includes, in its rear portion, a bearing holder 51 that is axially integral with the inner housing 3 with four connecting plates 51*a*. The connecting plates 51*a* each extend radially and connect to the inner surface of the inner housing 3.

With four notches 59 circumferentially aligned with the corresponding engagement portions 111, the stator 32 is placed into the inner housing 3 from the front. As shown in FIG. 15B, the notches 59 are engaged with the corresponding engagement portions 111 to lock the stator 32 in a nonrotatable manner and restrict the stator 32 from moving rearward. In this state, the inner surfaces of the receiving surfaces 110, excluding the engagement portions 111, are in contact with the outer surface of a stator core 34, thus holding the stator 32.

The inner housing 3 has a pair of slits 112 at upper and lower positions that are point-symmetric to each other about the axis. Each slit 112 has a front end in a flared portion 30 and is elongated rearward. Screw bosses 113 are located adjacent to the rear ends of the slits 112 on the same axis as the front ends of the slits 112. The screw bosses 113 protrude from the outer surface of the inner housing 3.

The inner housing 3 has a fitting protrusion 114 on its left side surface. The fitting protrusion 114, which is a rib with a predetermined vertical width, extends in the front-rear direction from the flared portion 30 to the rear end of the inner housing 3. The inner housing 3 has, on its right and left outer surfaces, a pair of inner projections 115 elongated in the front-rear direction.

A baffle plate 47, which is attached to the front of the stator 32, includes a pair of small cylinders 116 on its upper and lower portions. The small cylinders 116 protrude radially outward. The small cylinders 116 are fitted into the slits 112 in the inner housing 3 and come in contact with the screw bosses 113 from the front. Each small cylinder 116 is integral with a front stopper 117 located on its radially inner surface. The front stopper 117 has an arch-shaped cross section and protrudes radially inward from the inner circumferential surface of the inner housing 3.

Figure 11:
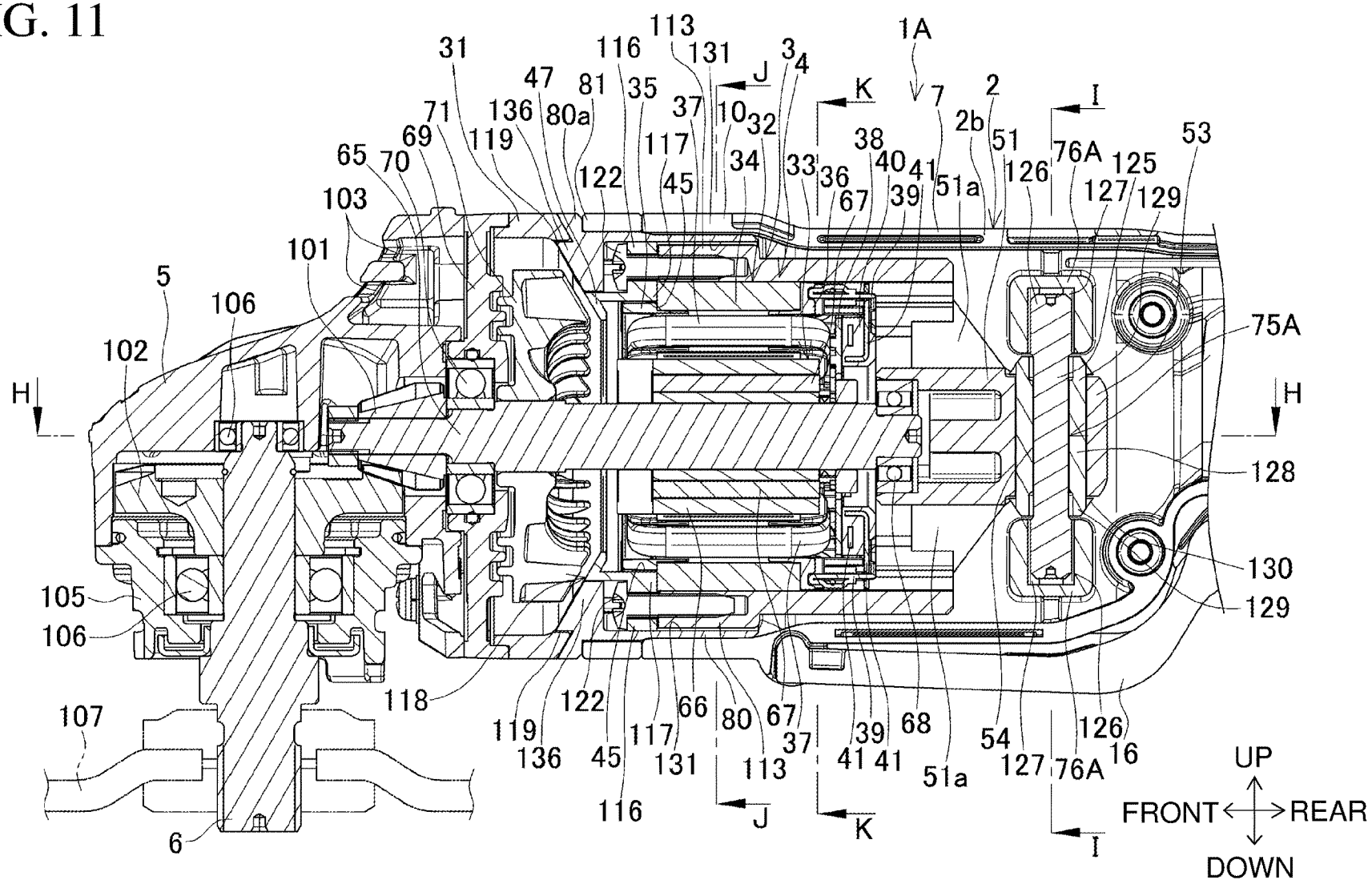
FIG. 11 is an enlarged partial central sectional view of a grinder according to a modification, showing an elastic holding structure of an inner housing.

The baffle plate 47 presses, rearward, the upper and lower small cylinders 116 received in the slits 112 and placed in front of the screw bosses 113. As shown in FIG. 11, the front stoppers 117 are fitted into the fitting recesses 45 on the front insulator 35 to come in contact with the front surface of the stator core 34, positioning the stator 32 from the front.

After the positioning, the flared portion 30 and the baffle plate 47 define a bowl-shaped flow regulating portion 118 behind a centrifugal fan 71. The flow regulating portion 118 is defined by the flared portion 30 located radially outside the inner housing 3 and the baffle plate 47 located radially inside the inner housing 3.

The flow regulating portion 118 has, between the flared portion 30 and the baffle plate 47, circular holes 119 in front of the screw bosses 113 and the front stoppers 117. The circular holes 119 are each defined by a semicircular front end of the slit 112 cut in the flared portion 30 as viewed from the front and by a semicircular cutout 120 in the outer circumferential surface of the baffle plate 47 as viewed from the front. The baffle plate 47 has, on its left front end, a projection 121 for closing a cutout defined by the fitting protrusion 114 in the front surface of the flared portion 30.

In this state, screws 122 are screwed into the screw bosses 113 from the front through the circular holes 119 and the small cylinders 116. The baffle plate 47 is fastened with the front surface continuously connected to the front surface of the flared portion 30, defining the flow regulating portion 118. The baffle plate 47 also stably holds the stator 32 between the baffle plate 47 and the engagement portions 111.

The elastic holding structure of the inner housing 3 will now be described. A connecting rod 75A is directly held in rod receivers 76A without rubber caps in the rear portion of the inner housing 3. The connecting rod 75A includes portions with two different diameters, or specifically a smaller-diameter portion 125 in the middle and larger-diameter portions 126 at the upper and lower ends. The smaller-diameter portion 125 extends through a through-hole 54 in a joint 53 in the inner housing 3. The larger-diameter portions 126 protrude upward and downward from the joint 53. The rod receivers 76A each have semicircular receiving recesses 127 on their surfaces facing each other. The receiving recesses 127 hold the larger-diameter portion 126 from the right and the left.

A rubber sleeve 128 is externally fitted on the smaller-diameter portion 125. The rubber sleeve 128 is thick in the radial direction.

The rubber sleeve 128 has catchers 129 on its outer circumferences at both ends as shown in FIG. 13. One catcher 129 flares toward the other. The catcher 129 has multiple cutouts 130 on its outer circumference at circumferentially equal intervals.

Figure 14:
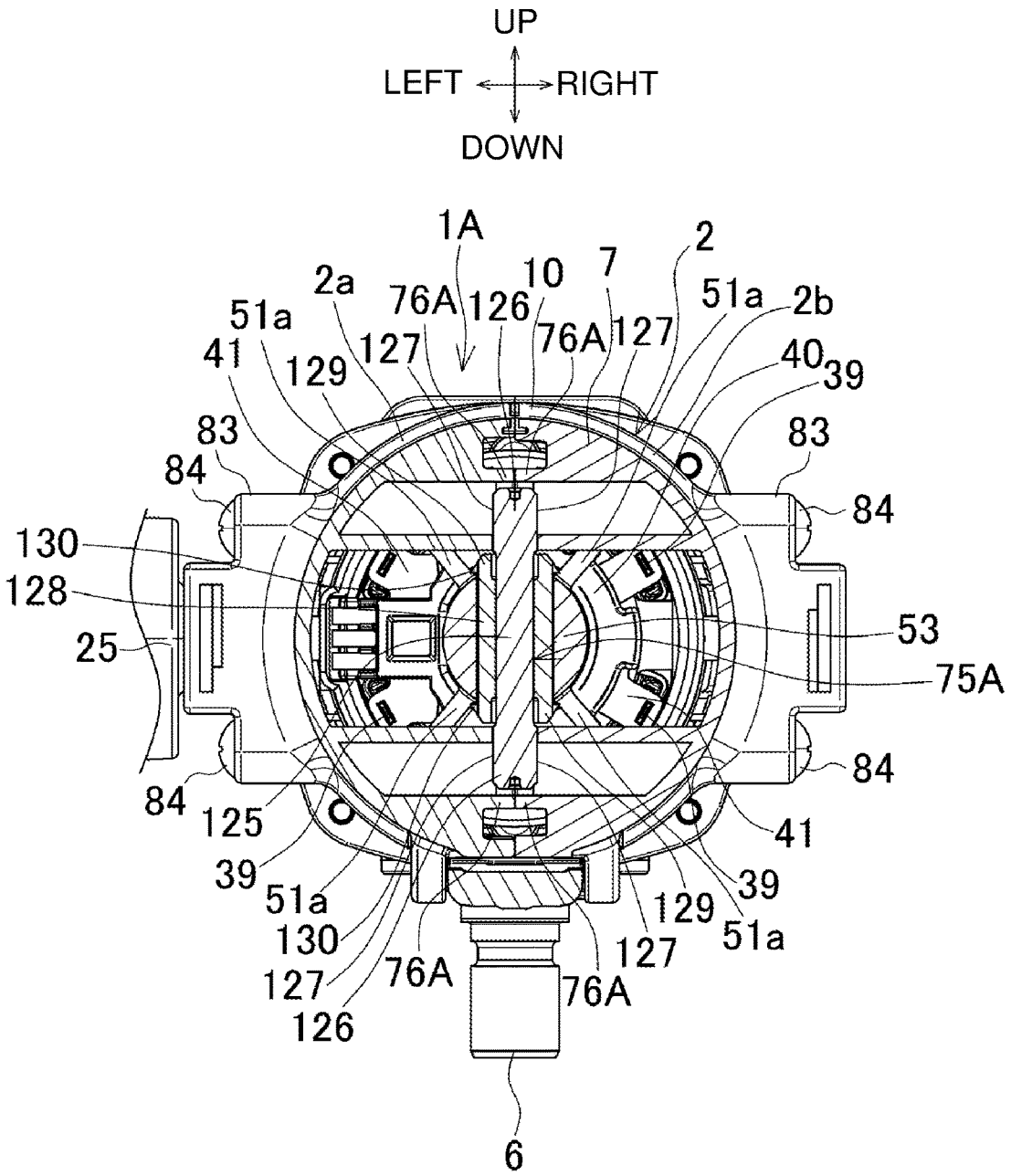
FIG. 14 is a cross-sectional view taken along line I-I in FIG. 11.

The rubber sleeve 128 is inserted in the through-hole 54 in the joint 53 together with the connecting rod 75A. The leading catcher 129 guides the rubber sleeve 128 to be placed in the through-hole 54. Once the connecting rod 75A is placed through the joint 53, the catchers 129 on the two ends are engaged with the upper and lower ends of the joint 53 to position the rubber sleeve 128 as shown in FIG. 14. The inner housing 3 and the connecting rod 75A are thus elastically connected with the rubber sleeve 128 between them.

As shown in FIG. 15A, a rubber cylinder 80 has, at upper and lower positions of its inner circumferential surface, a pair of grooves 131 extending in the front-rear direction. With the rubber cylinder 80 externally mounted on the inner housing 3, the screw bosses 113 are fitted into the grooves 131.

The rubber cylinder 80 has, on its left inner surface, a positioning groove 132 extending in the front-rear direction. With the rubber cylinder 80 externally mounted on the inner housing 3, the fitting protrusion 114 is fitted into the positioning groove 132.

The rubber cylinder 80 has, on its right and left rear, a pair of ribs 133 raised radially outward. Each rib 133 has a middle slit 134 extending from the rear end of the rubber cylinder 80. With the rubber cylinder 80 externally mounted on the inner housing 3, the inner projections 115 are engaged with the corresponding middle slits 134. Each rib 133 has a pair of upper and lower outer slits 135, which are parallel to the middle slit 134, extending from the rear end of the rubber cylinder 80.

The rubber cylinder 80 has a pair of positioning projections 136 at upper and lower front positions of its inner circumferential surface. The positioning projections 136 are fitted into the circular holes 119 in the flow regulating portion 118 and close the circular holes 119.

The outer housing 2 has, on its right and left inner surfaces, a pair of recesses 140 as shown in FIGS. 13 and 15A. The recesses 140 are engaged with the ribs 133 on the rubber cylinder 80. A pair of upper and lower outer projections 141 are located above and under the recesses 140. Each outer projection 141 is elongated in the front-rear direction. The outer projections 141 are engaged with the corresponding outer slits 135.

The handle mounts 83 in front of the recesses 140 each have a receiving hole 142 that is a laterally extending through-hole. A fixing ring 81 includes screw cylinders 143. The screw cylinders 143 protrude outward from right and left flat surfaces 82 of the fixing ring 81. The screw cylinders 143 are fitted into the receiving holes 142. A threaded portion 26 of a side handle 25 is screwed into the screw cylinder 143 (FIG. 12).

In the present modification, the inner housing 3 and the connecting rod 75A are connected with the rubber sleeve 128 (rear elastic member) between them. The connecting rod 75A is more accurately positioned and supported in the rod receivers 76A without tilting. The inner housing 3 can thus support the spindle 6 positioned accurately without tilting.

In particular, the connecting rod 75A is directly held in the rod receivers 76A on the outer housing 2. The connecting rod 75A is thus accurately positioned and supported once the connecting rod 75A is placed in the rod receivers 76A.

The inner housing 3 includes the inner projections 115 (first engaging portions). The rubber cylinder 80 has the middle slits 134 (first receiving portions) engageable with the inner projections 115 in the rotation direction about an axis in the front-rear direction and the ribs 133 (second engaging portions). The outer housing 2 has the recesses 140 (second receiving portions) engageable with the ribs 133 in the rotation direction. This structure restricts rattling between the outer housing 2 and the inner housing 3 in the circumferential direction (rotation direction) of the rubber cylinder 80, thus allowing highly reliable positioning.

The inner housing 3 has, on its outer surface, the inner projections 115 (projections) to be the first engaging portions. The rubber cylinder 80 has the middle slits 134 engageable with the inner projections 115. Further, the ribs 133 (second engaging portions) raised from the outer surface of the rubber cylinder 80 include portions with the middle slits 134. The outer housing 2 has, on its inner surface, the recesses 140 to be the second receiving portions. The outer housing 2 and the inner housing 3 are thus effectively positioned in the rotation direction with the rubber cylinder 80 in between.

In some modifications, the connecting rod may have a uniform diameter along the full length rather than including portions with two different diameters, or the catchers on the rubber sleeve may be eliminated. The rubber sleeve may not be a single sleeve. Multiple shorter rubber sleeves may be used.

The engagement structures for the inner housing and the rubber cylinder may also be modified by changing, for example, the number of inner projections and their shapes or positions, or the number of ribs and their shapes or positions. The numbers of middle slits and outer slits and their shapes or positions may also be changed. These slits may be replaced by through-holes or recesses. The recesses and the outer projections may also be changed.

Although the inner housing includes the projections (first engaging portions) and the rubber cylinder has the middle slits (first receiving portions) in the above modification, the rubber cylinder may include the first engaging portions such as projections on its inner surface and the inner housing may have the first receiving portions such as recesses or through-holes. Similarly, although the rubber cylinder includes the ribs (second engaging portions) and the outer housing has the recesses (second receiving portions) in the above modification, the outer housing may include the second engaging portions such as projections on its inner surface and the rubber cylinder may have the second receiving portions such as recesses or through-holes.

REFERENCE SIGNS LIST

1, 1A rechargeable grinder
2 outer housing
3 inner housing
4 brushless motor
5 gear housing
6 spindle
7 front cylinder
8 rear cylinder
9 battery mount
10 larger-diameter portion
11 battery pack
20 controller
25 side handle
26 threaded portion
30 flared portion
31 expanded portion
32 stator
33 rotor
50 bearing retainer
51 bearing holder
53 joint
61 lock ring
65 rotational shaft
75, 75A connecting rod
76, 76A rod receiver
78 rubber cap
80 rubber cylinder
81 fixing ring
83 handle mount
86 handle detector
87 detection plate
88 photointerrupter
93 light shield
97 photoreceiver
98 receiver
107 tip tool
115 inner projection
125 smaller-diameter portion
126 larger-diameter portion
128 rubber sleeve
133 rib
134 middle slit
135 outer slit
140 recess
141 outer projection

What is claimed is:

1. A grinder, comprising:
an inner housing accommodating a motor;
a final output shaft located in front of the motor;
a connecting shaft parallel to the final output shaft;
a front elastic member located in front of the connecting shaft; and
an outer housing enclosing the inner housing and holding, with the connecting shaft and the front elastic member in between, the inner housing in a relatively rotatable manner.

2. The grinder according to claim 1, further comprising:
a rear elastic member connecting the inner housing and the connecting shaft.

3. The grinder according to claim 2, wherein
the connecting shaft is directly held on the outer housing.

4. The grinder according to claim 2, wherein
the inner housing includes a first engaging portion,
the front elastic member includes a first receiving portion engageable with the first engaging portion in a rotation direction about an axis in a front-rear direction and a second engaging portion, and
the outer housing includes a second receiving portion engageable with the second engaging portion in the rotation direction.

5. The grinder according to claim 2, wherein
the outer housing includes a second engaging portion,
the front elastic member includes a first engaging portion and a second receiving portion engageable with the second engaging portion in the rotation direction, and
the inner housing includes a first receiving portion engageable with the first engaging portion in the rotation direction about an axis in a front-rear direction.

6. The grinder according to claim 1, wherein
the connecting shaft is directly held on the outer housing.

7. The grinder according to claim 6, wherein
the inner housing includes a first engaging portion,
the front elastic member includes a first receiving portion engageable with the first engaging portion in a rotation direction about an axis in a front-rear direction and a second engaging portion, and
the outer housing includes a second receiving portion engageable with the second engaging portion in the rotation direction.

8. The grinder according to claim 1, wherein
the inner housing includes a first engaging portion,
the front elastic member includes a first receiving portion engageable with the first engaging portion in a rotation direction about an axis in a front-rear direction and a second engaging portion, and
the outer housing includes a second receiving portion engageable with the second engaging portion in the rotation direction.

9. The grinder according to claim 8, wherein
the first engaging portion includes a projection on an outer surface of the inner housing,
the first receiving portion and the second engaging portion protrude outward from the front elastic member, and
the second receiving portion includes a recess on an inner surface of the outer housing.

10. The grinder according to claim 1, wherein
the outer housing includes a second engaging portion,
the front elastic member includes a first engaging portion and a second receiving portion engageable with the second engaging portion in the rotation direction, and
the inner housing includes a first receiving portion engageable with the first engaging portion in the rotation direction about an axis in a front-rear direction.

11. The grinder according to claim 10, wherein
the first engaging portion includes a projection on an inner surface of the front elastic member,
the first receiving portion includes a recess on an outer surface of the inner housing,
the second engaging portion includes a projection on an inner surface of the outer housing, and
the second receiving portion includes a recess on an outer surface of the front elastic member.

12. The grinder according to claim 1, further comprising:
a rear elastic member holding the connecting shaft in the outer housing.

13. The grinder according to claim 12, wherein
the rear elastic member has a lower hardness than the front elastic member.

14. The grinder according to claim 1, wherein
the outer housing includes a mount to which a side handle is attachable.

15. The grinder according to claim 1, wherein
the outer housing includes a pair of right and left half housings, and
the grinder further includes a ring mounting the half housings externally onto the inner housing with the front elastic member in between.

16. The grinder according to claim 1, wherein
the inner housing further includes a metal joint portion connected to the connecting shaft.

17. The grinder according to claim 1, wherein
the inner housing includes a cylindrical holder accommodating the motor.

18. The grinder according to claim 1, wherein
the outer housing accommodates an electric component other than the motor.

19. The grinder according to claim 1, wherein
the outer housing includes a battery to be a power supply.

20. The grinder according to claim 1, further comprising:
a handle integral with the outer housing.

* * * * *